US008291592B2

(12) United States Patent
Saxton et al.

(10) Patent No.: US 8,291,592 B2
(45) Date of Patent: Oct. 23, 2012

(54) METHOD OF LENGTHENING A CONTAINER WELL OF A RAILCAR

(75) Inventors: Gregory J. Saxton, Portland, OR (US); John N. Niosi, Troutdale, OR (US)

(73) Assignee: Gunderson LLC, Portland, OR (US)

( * ) Notice: Subject to any disclaimer, the term of this patent is extended or adjusted under 35 U.S.C. 154(b) by 349 days.

(21) Appl. No.: 12/661,479

(22) Filed: Mar. 17, 2010

(65) Prior Publication Data

US 2011/0226153 A1 Sep. 22, 2011

(51) Int. Cl.
*B21D 47/00* (2006.01)
*B21K 21/16* (2006.01)
*B61D 3/00* (2006.01)

(52) U.S. Cl. ..... 29/897.1; 29/897.2; 29/401.1; 29/426.4; 29/445; 29/428; 29/462; 105/355; 105/404

(58) Field of Classification Search ..... 29/897, 29/897.1, 897.2, 401.1, 428, 426.4, 445, 29/462; 105/355, 404
See application file for complete search history.

(56) References Cited

U.S. PATENT DOCUMENTS

| | | | |
|---|---|---|---|
| 717,488 | A | 5/1903 | Swanson |
| 1,085,196 | A | 1/1914 | Downing |
| 1,110,394 | A | 9/1914 | Lindall |
| 1,114,552 | A | 10/1914 | Taurman |
| 1,168,335 | A | 1/1916 | Rowntree |
| 1,617,658 | A | 2/1927 | Suarez |
| 1,634,490 | A | 7/1927 | Collis |
| 1,696,332 | A | 12/1928 | Sheehan |
| 1,699,520 | A | 1/1929 | Gibbs et al. |
| 1,699,529 | A | 1/1929 | Gibbs et al. |
| 1,875,584 | A | 9/1932 | Frede et al. |
| 1,889,605 | A | 11/1932 | Jones |
| 2,052,213 | A | 8/1936 | Branstrator |
| 2,194,356 | A | 3/1940 | Eklund |
| 2,255,900 | A | 9/1941 | Schlessinger |
| 2,278,554 | A | 4/1942 | Morton |
| 2,279,756 | A | 4/1942 | Lieberman |
| 2,327,585 | A | 8/1943 | Ulrich |
| 2,401,401 | A | 6/1946 | Bartsch |
| 2,504,112 | A | 4/1950 | Dean et al. |

(Continued)

FOREIGN PATENT DOCUMENTS

DE 37 11 409 A1 10/1987

(Continued)

OTHER PUBLICATIONS

U.S. Appl. No. 11/985,400, filed Nov. 4, 2007, Saxton et al.

*Primary Examiner* — Sarang Afzali
(74) *Attorney, Agent, or Firm* — Chernoff Vilhauer McClung & Stenzel LLP

(57) ABSTRACT

A railroad freight car with a lengthened container well, including an extended and reinforced well car unit side sill, and a method for lengthening a container well of a railroad freight car intended for carrying an intermodal cargo container. A side sill extension member is welded into position, between a body bolster at each end of the container well unit and a nearest container support assembly, and a container-well bottom assembly is lengthened at each end of the container well. A longitudinally-extending doubler plate may be welded to the longitudinally central portion of the side sill, to ensure sufficient rail clearance at mid-length of the car.

8 Claims, 21 Drawing Sheets

U.S. PATENT DOCUMENTS 3,102,613 A 9/1963 Johnston
3,152,667 A 10/1964 Johnston
3,152,669 A 10/1964 Johnston
3,181,440 A 5/1965 Mullaney et al.
3,290,058 A 12/1966 Ellerd
3,308,769 A 3/1967 Halcomb et al.
3,319,583 A 5/1967 Gutridge
3,357,371 A 12/1967 Gutridge
3,389,663 A 6/1968 Gutridge
3,420,192 A 1/1969 Ellis
3,479,724 A 11/1969 Kruizenga et al.
3,520,256 A 7/1970 Gutridge
3,616,764 A 11/1971 Johnson et al.
3,645,213 A 2/1972 Taylor
3,659,724 A 5/1972 Miller et al.
3,731,967 A 5/1973 Hughes
3,818,843 A 6/1974 Lee
3,981,548 A 9/1976 MacDonnell et al.
4,064,947 A 12/1977 Cole
4,091,742 A 5/1978 Cordani
4,150,628 A 4/1979 Keldenich
4,179,997 A 12/1979 Kirwan
4,191,107 A 3/1980 Ferris et al.
4,231,144 A 11/1980 Bernacchia, Jr.
4,233,909 A 11/1980 Adams et al.
4,274,776 A 6/1981 Paton et al.
4,288,957 A 9/1981 Meehan
4,331,083 A 5/1982 Landregan et al.
4,342,146 A 8/1982 Hanson
4,408,810 A 10/1983 Geyer
4,428,296 A 1/1984 Scheuchzer et al.
4,452,147 A 6/1984 Jwuc
4,456,413 A 6/1984 Pavlick
4,516,506 A 5/1985 Paton
4,524,699 A 6/1985 Pavlick
4,562,633 A 1/1986 Adams et al.
4,563,957 A 1/1986 Billingsley et al.
4,597,337 A 7/1986 Willetts
4,599,949 A 7/1986 Hill
4,624,188 A 11/1986 Kaleta
4,671,714 A 6/1987 Bennett
4,686,907 A 8/1987 Woollam et al.
4,696,237 A 9/1987 Miller
4,703,699 A 11/1987 Hill
4,718,353 A 1/1988 Schuller et al.
4,741,273 A 5/1988 Sherwood
4,750,431 A 6/1988 Yates et al.
4,751,882 A 6/1988 Wheatley et al.
4,754,709 A 7/1988 Gramse et al.
4,771,706 A 9/1988 Lindauer et al.
4,782,762 A 11/1988 Johnstone et al.
4,792,269 A 12/1988 Engle
4,798,148 A 1/1989 Girard
4,802,420 A 2/1989 Butcher et al.
4,805,539 A 2/1989 Ferris et al.
4,807,722 A 2/1989 Jamrozy et al.
4,841,876 A 6/1989 Gramse et al.
4,862,810 A 9/1989 Jamrozy et al.
4,864,938 A 9/1989 Hesch et al.
4,876,968 A 10/1989 Lindauer et al.
4,889,055 A 12/1989 Jamrozy et al.
4,893,567 A 1/1990 Hill et al.
4,901,649 A 2/1990 Fehrenbach et al.
4,905,608 A 3/1990 Terlecky et al.
4,909,157 A 3/1990 Jamrozy et al.
4,911,082 A 3/1990 Richmond
4,929,132 A 5/1990 Yeates et al.
4,947,760 A 8/1990 Dawson et al.
4,949,646 A 8/1990 Jamrozy et al.
4,951,575 A 8/1990 Dominguez et al.
4,955,144 A 9/1990 Lienard et al.
4,966,082 A 10/1990 Takeichi et al.
5,001,990 A 3/1991 Pavlick
5,017,064 A 5/1991 Kirwan et al.
5,020,445 A 6/1991 Adams, Jr.
5,054,403 A 10/1991 Hill et al.
5,085,152 A 2/1992 Tylisz et al.
5,090,331 A 2/1992 Hesch et al.
5,170,718 A 12/1992 Hill et al.
5,181,474 A * 1/1993 Miller ..... 105/355
5,197,392 A 3/1993 Jeunehomme
5,207,161 A 5/1993 Pileggi et al.
5,216,956 A 6/1993 Adams, Jr.
5,246,321 A 9/1993 Hesch
5,279,230 A 1/1994 Thomas et al.
5,372,073 A 12/1994 Cattani
5,407,309 A 4/1995 Hesch et al.
5,423,269 A 6/1995 Saxton et al.
5,452,664 A 9/1995 Richmond
5,465,670 A 11/1995 Butcher
5,501,556 A 3/1996 Butcher
5,511,491 A 4/1996 Hesch et al.
5,520,489 A 5/1996 Butcher et al.
5,611,285 A 3/1997 Saxton
5,626,083 A 5/1997 Saxton
5,657,698 A 8/1997 Black, Jr. et al.
5,730,063 A 3/1998 Forbes et al.
5,743,191 A 4/1998 Coslovi
5,749,686 A 5/1998 Butcher et al.
6,003,445 A 12/1999 Coslovi et al.
6,095,055 A 8/2000 Lohr et al.
6,196,137 B1 3/2001 Forbes
6,199,486 B1 3/2001 Landrum et al.
6,357,363 B1 3/2002 Militaru
6,502,518 B1 1/2003 Miller
6,505,564 B2 1/2003 Khattab
6,510,800 B1 1/2003 Zaerr et al.
6,546,878 B1 4/2003 Smith et al.
6,584,912 B2 7/2003 Forbes
7,401,559 B2 * 7/2008 Dawson et al. ..... 105/243
7,654,206 B2 2/2010 Saxton
2007/0261593 A1 11/2007 Saxton
2009/0078152 A1 3/2009 Halliar et al.
2010/0024680 A1 2/2010 Saxton et al.
2010/0180516 A1 * 7/2010 Dawson et al. ..... 52/53

FOREIGN PATENT DOCUMENTS

EP 0510372 A1 10/1992
EP 0510467 A1 10/1992

* cited by examiner

METHOD OF LENGTHENING A CONTAINER WELL OF A RAILCAR

BACKGROUND OF THE INVENTION

The present invention relates to railroad freight cars including wells for carrying intermodal cargo containers, and relates particularly to lengthening existing container well cars to carry containers of a greater length.

Many railroad freight cars were built over a period of several years, beginning in the 1980's, to be able to carry intermodal cargo containers 48 feet long, as well as containers of the international standard 40-foot length, in container wells defined between deep side sills of the car bodies. Railroad cars of this type are disclosed in U.S. Pat. Nos. 5,611,285 and 5,170,718, for example. Many of such 48-foot well cars were built as multi-unit cars, each usually having five container-well car units permanently coupled together.

Recently, longer containers such as nominal 53-foot containers have largely replaced 48-foot containers. Many 48-foot well car units that are still several years away from being worn out are now idled, because there are now too few 48-foot containers being moved. Since 48-foot well cars cannot accept the 53-foot containers except stacked atop shorter containers carried in the well, and since new 53-foot well car units are very costly, it is now desired to extend the length of some of the existing 48-foot well cars to enable them to carry 53-foot containers in the well.

Because a longer car body requires greater clearance at mid-length between the bottom of the car body and the rails than does a shorter car body, provision must be made to ensure ample clearance in the center of a lengthened car.

What is needed, then, is an economical method for lengthening container-well units of railroad freight cars, and a resulting strong, long-lasting, dependable, lengthened container-well car unit structure capable of carrying 53-foot containers efficiently over a further lifetime of several years.

SUMMARY OF THE INVENTION

The present disclosure provides an answer to the aforementioned need for an improved method for lengthening container-carrying well cars, and a structure for such cars, to carry standard 53-foot intermodal cargo containers.

According to one aspect of the disclosure, a method for converting well car units is disclosed in which preexisting container support assemblies are left attached to container well car side sills; a top chord, and a side sill web plate and bottom chord of each side sill are cut; and longitudinal extension portions of the top chord, bottom chord, and web plate are added to each side sill near an end of a container well car unit to be lengthened, between the container support assemblies and a respective body bolster.

According to one aspect of the disclosure herein side sill structures are revised near mid-length of the body of a lengthened well car unit to ensure a required amount of vertical clearance beneath the car body.

According to one aspect of the disclosure herein container-well bottom structures are extended in length at each end of a container-well car unit.

The foregoing and other features of the invention will be more readily understood upon consideration of the following detailed description of an embodiment of the invention taken in conjunction with the accompanying drawings.

BRIEF DESCRIPTION OF THE SEVERAL DRAWINGS

FIG. 1 is a foreshortened side elevational view of an end unit and a portion of an intermediate unit of a multi-unit railroad freight car including container wells defined between side sills of the car units to receive intermodal freight containers, showing the car units carrying cargo containers of a standard length that is equal to the length of each container well, as well as cargo containers of a longer standard length stacked atop containers in the wells.

Figure 4:
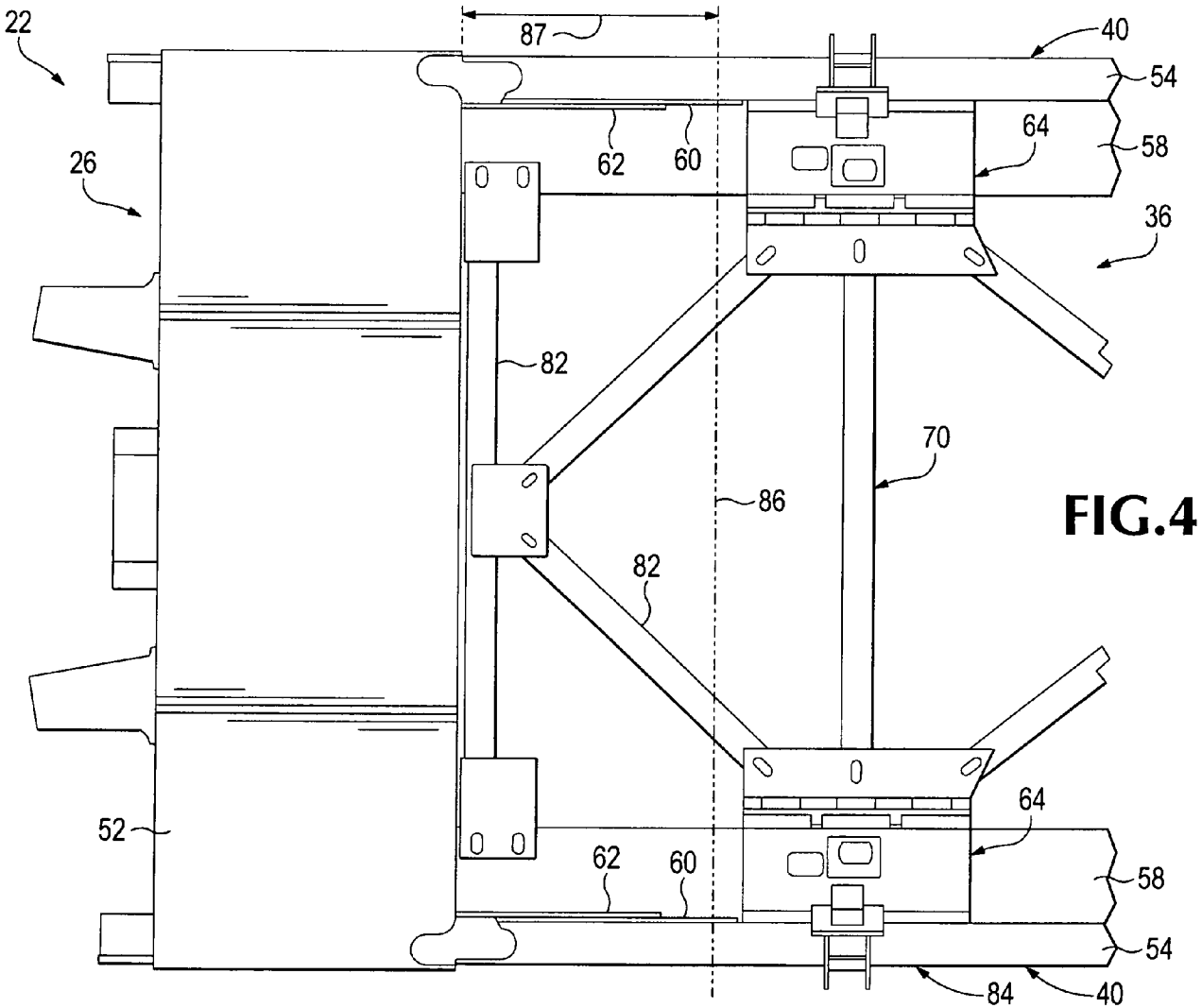
FIG. 4 is a top plan view of an intermediate end portion of the container well car end unit shown in FIG. 1.
Figure 6:
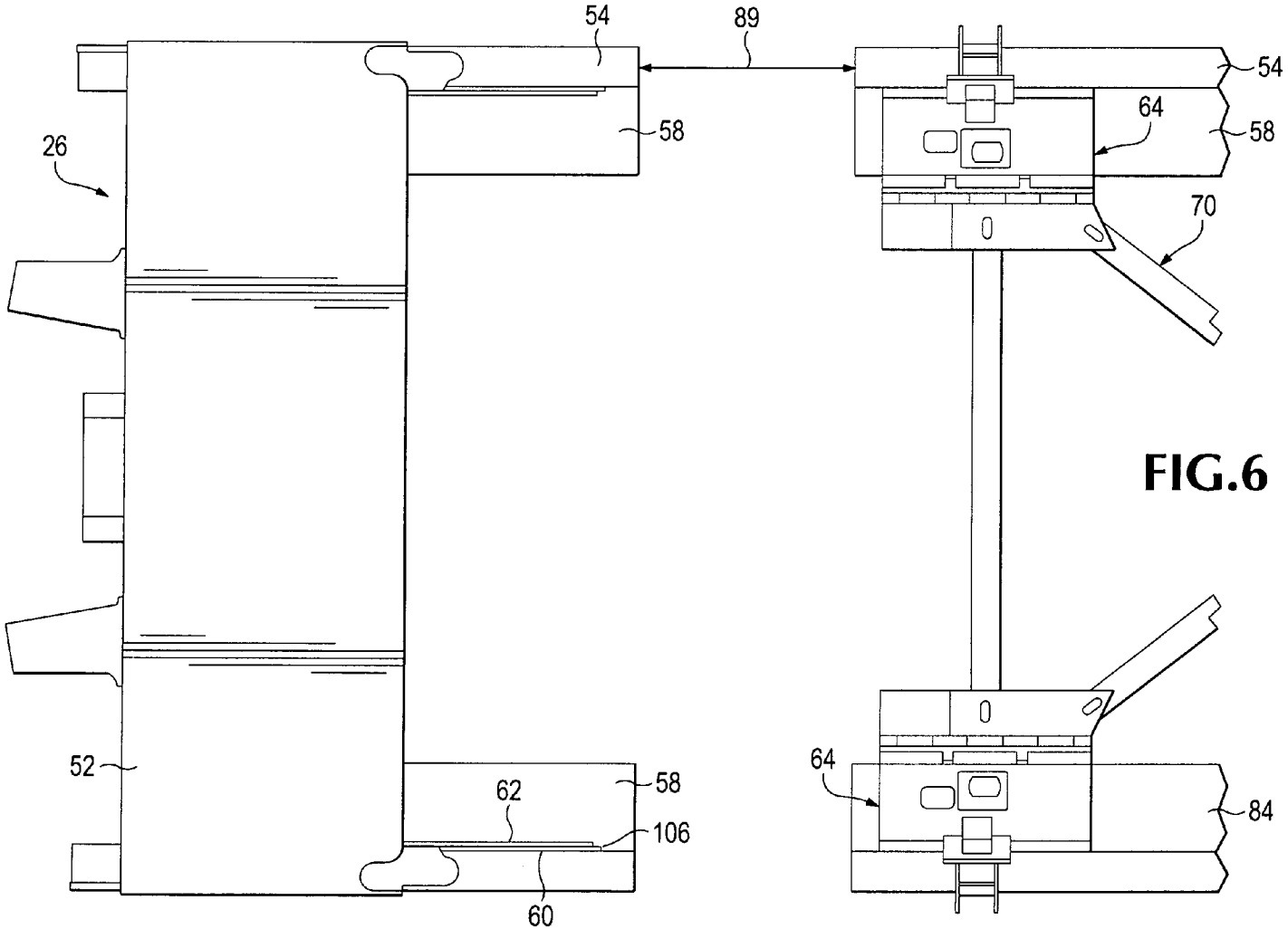

FIG. 6 is a top plan view of the portion of a container well car unit shown in FIG. 4, but showing its condition after the side sills have been cut and a portion of the well bottom truss assembly has been cut away, and in which the end portion of the car unit body has been moved away from the longitudinally central portion of the car unit body, as part of the process of lengthening the intermediate end of the well car unit.

Figure 3:
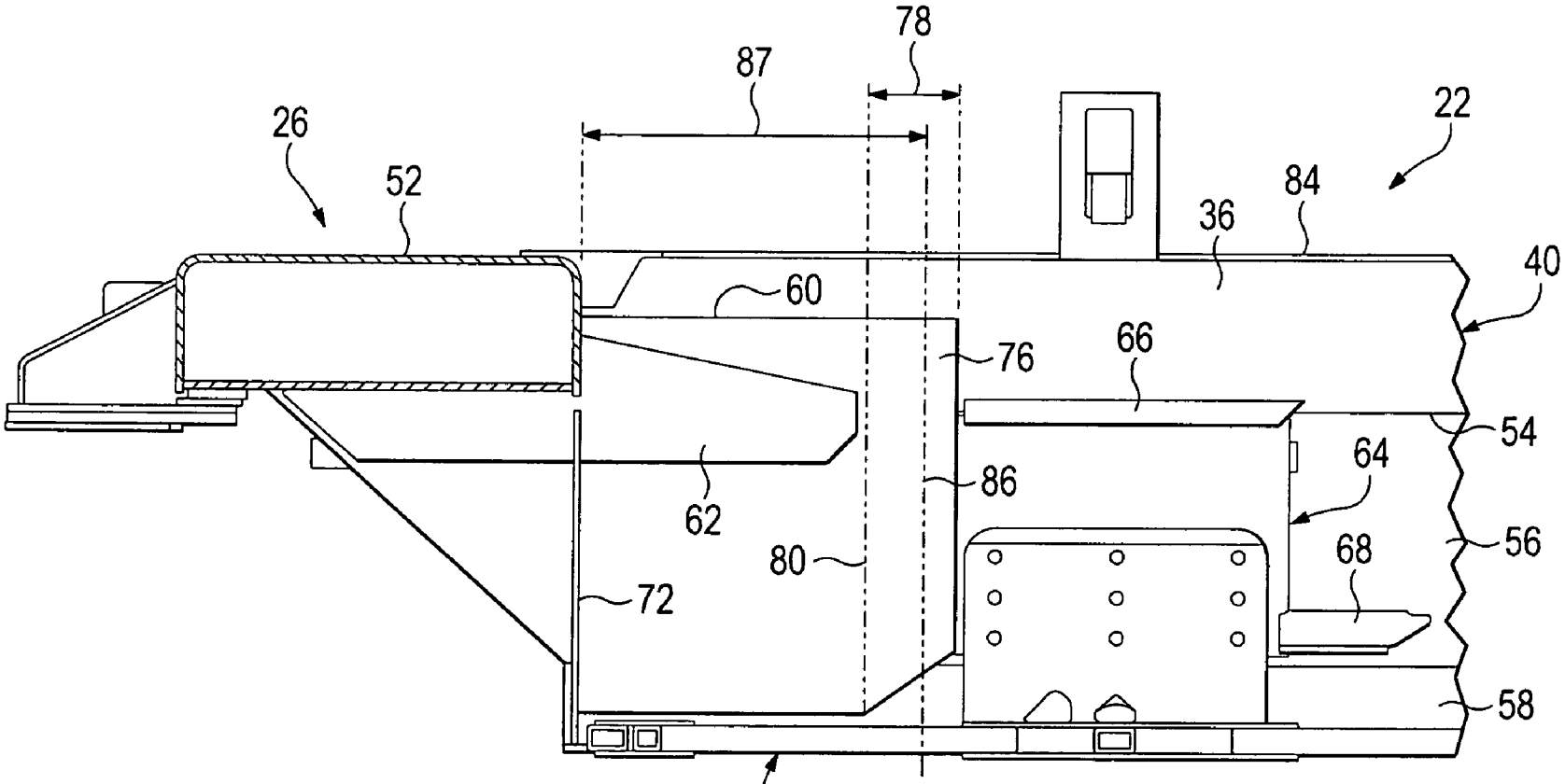
FIG. 3 is a side elevational view of a portion of a side sill of a container well adjacent an intermediate end of an end unit of the freight car shown in FIG. 1, taken from within the container well and showing a body bolster of the car unit in sectional view.
Figure 5:
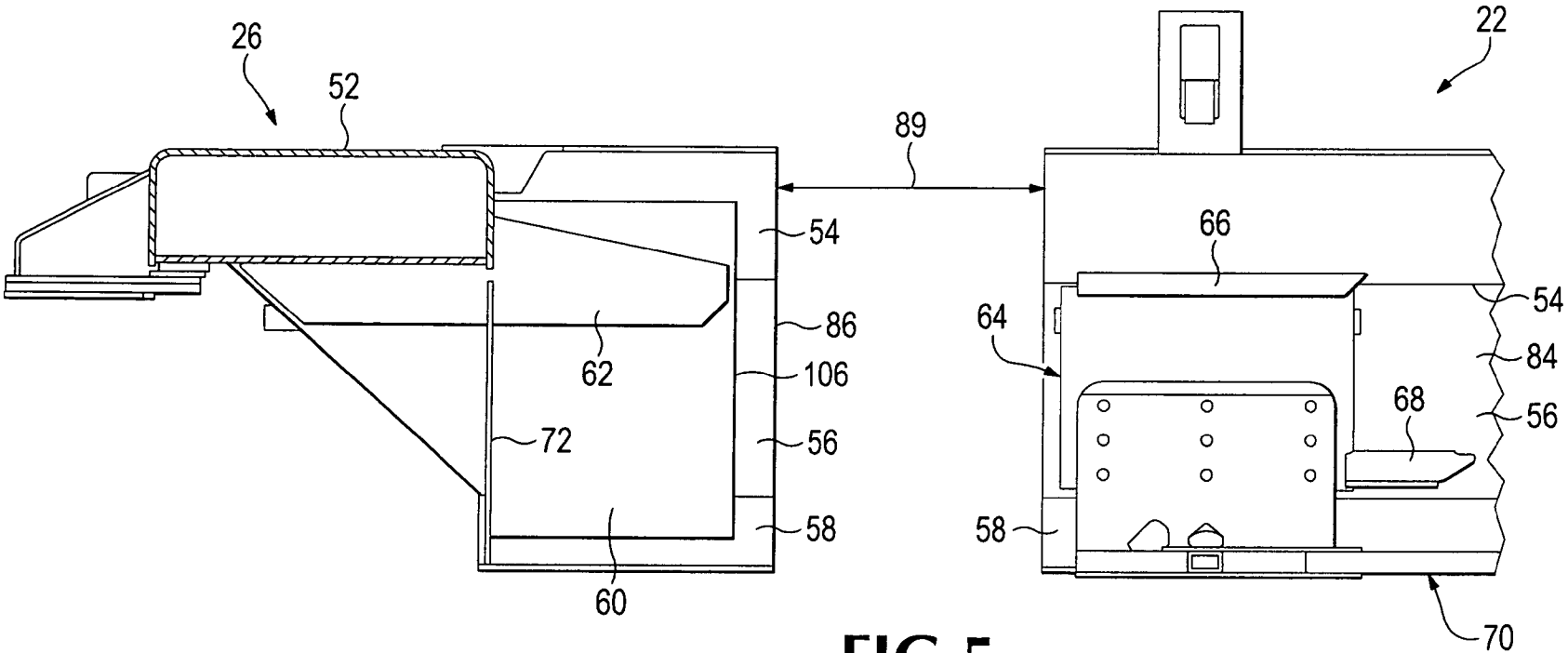
FIG. 5 is a view similar to FIG. 3, but showing the same portion of the car unit after the side sill has been cut and an end portion of the car unit body has been moved away from a longitudinally central portion of the car unit body, as part of the process lengthening the intermediate end of the well car unit.
Figure 7:
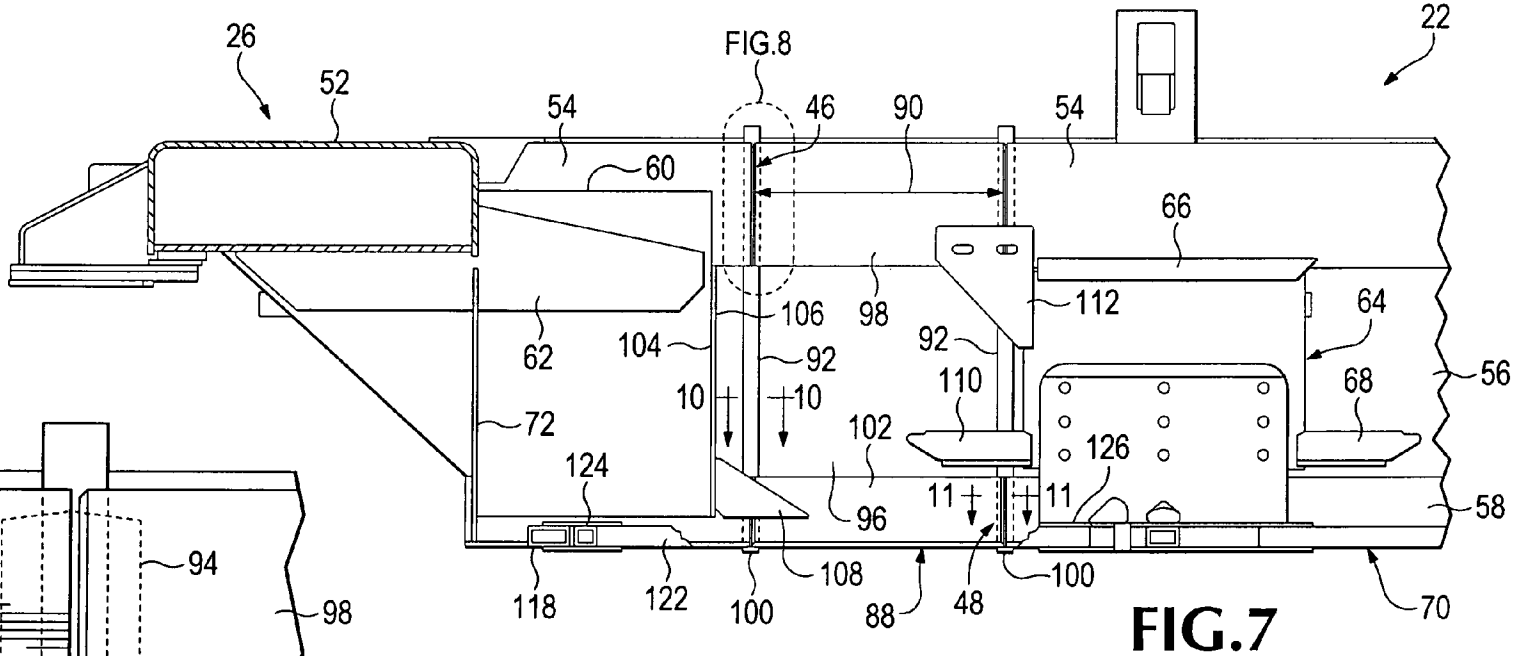

FIG. 7 is a side elevational view taken in the same direction as FIGS. 3 and 5, with a side sill extension portion installed between the intermediate end portion and the longitudinally central portion of the car unit body, to lengthen the container well at the intermediate end of the well car unit.

Figure 8:
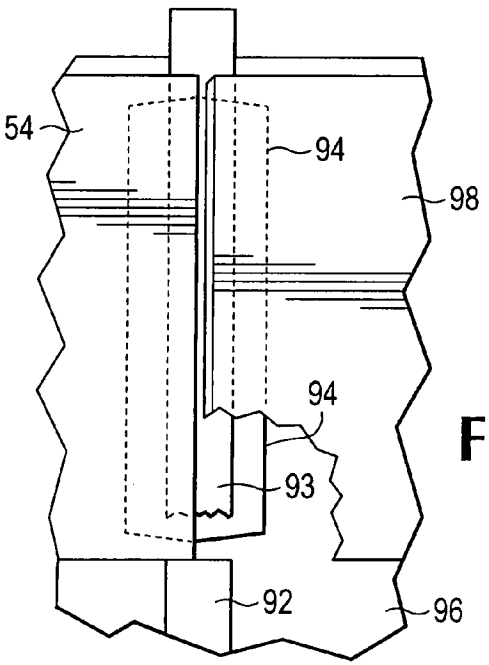

FIG. 8 is a partially cutaway view of a detail of the body of the car unit shown in FIG. 7.

Figure 9:
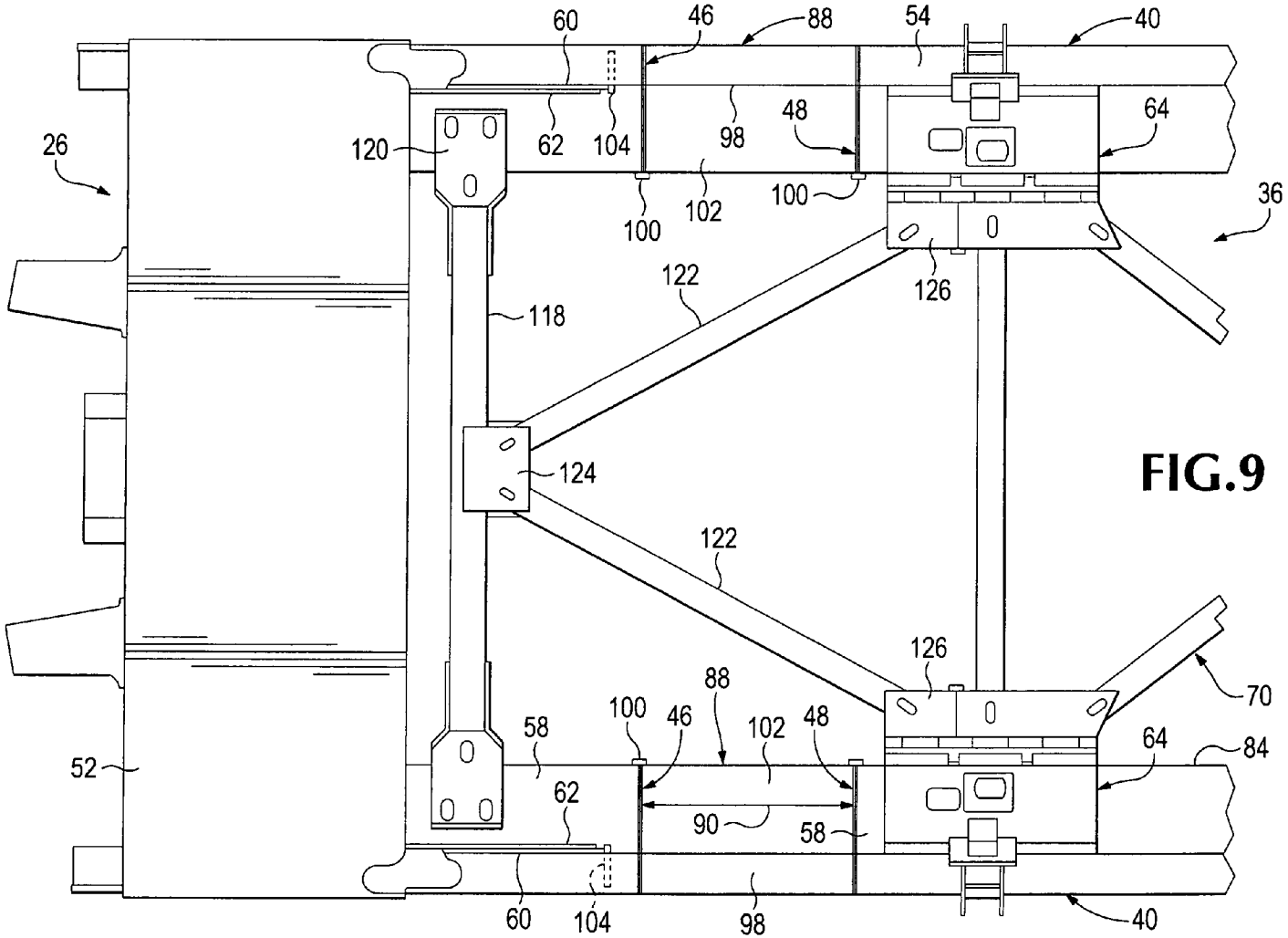

FIG. 9 is a top plan view similar to FIG. 6, with side sill extension portions installed between the intermediate end portion and the longitudinally central portion of the car unit body and a revised portion of a bottom truss assembly installed between the container support assemblies and the body bolster to lengthen the container well at the intermediate end of the well car unit.

Figure 10:
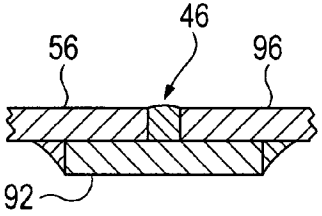

FIG. 10 is a section view of a detail, taken along line 10-10 in FIG. 7.

Figure 11:
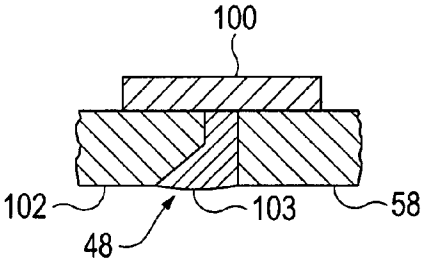

FIG. 11 is a sectional view of a detail, taken along line 11-11 in FIG. 7.

Figure 1:
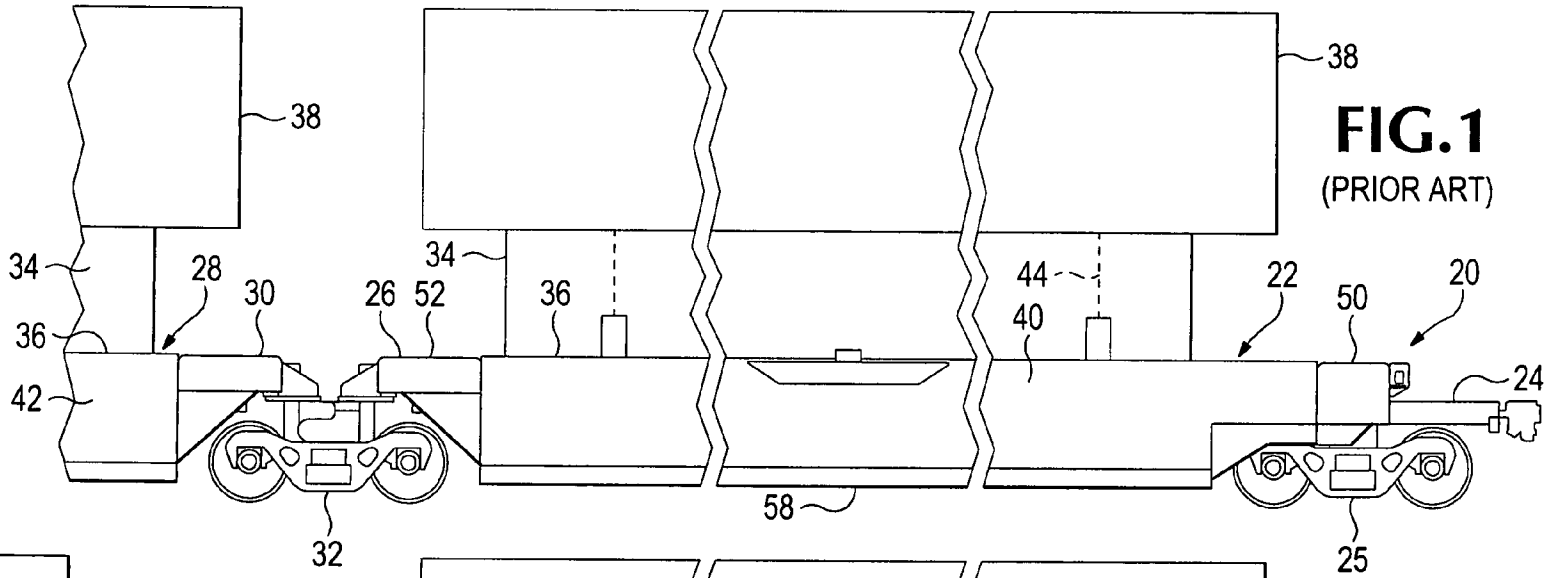
FIG.1 (PRIOR ART)
Figure 12:
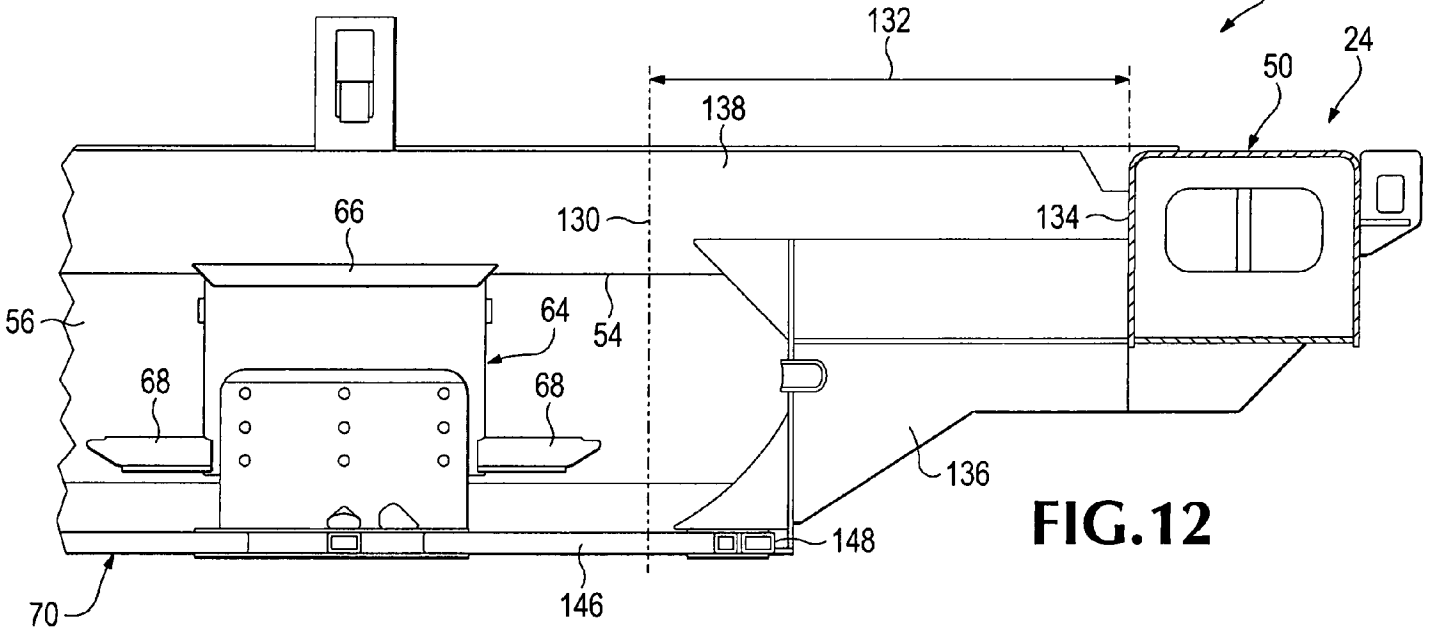

FIG. 12 is a side elevational view of a portion of a side sill of the container well at the coupler end of the end unit of the freight car shown in FIG. 1, taken from within the container well and showing the body bolster of the coupler end in sectional view.

Figure 13:
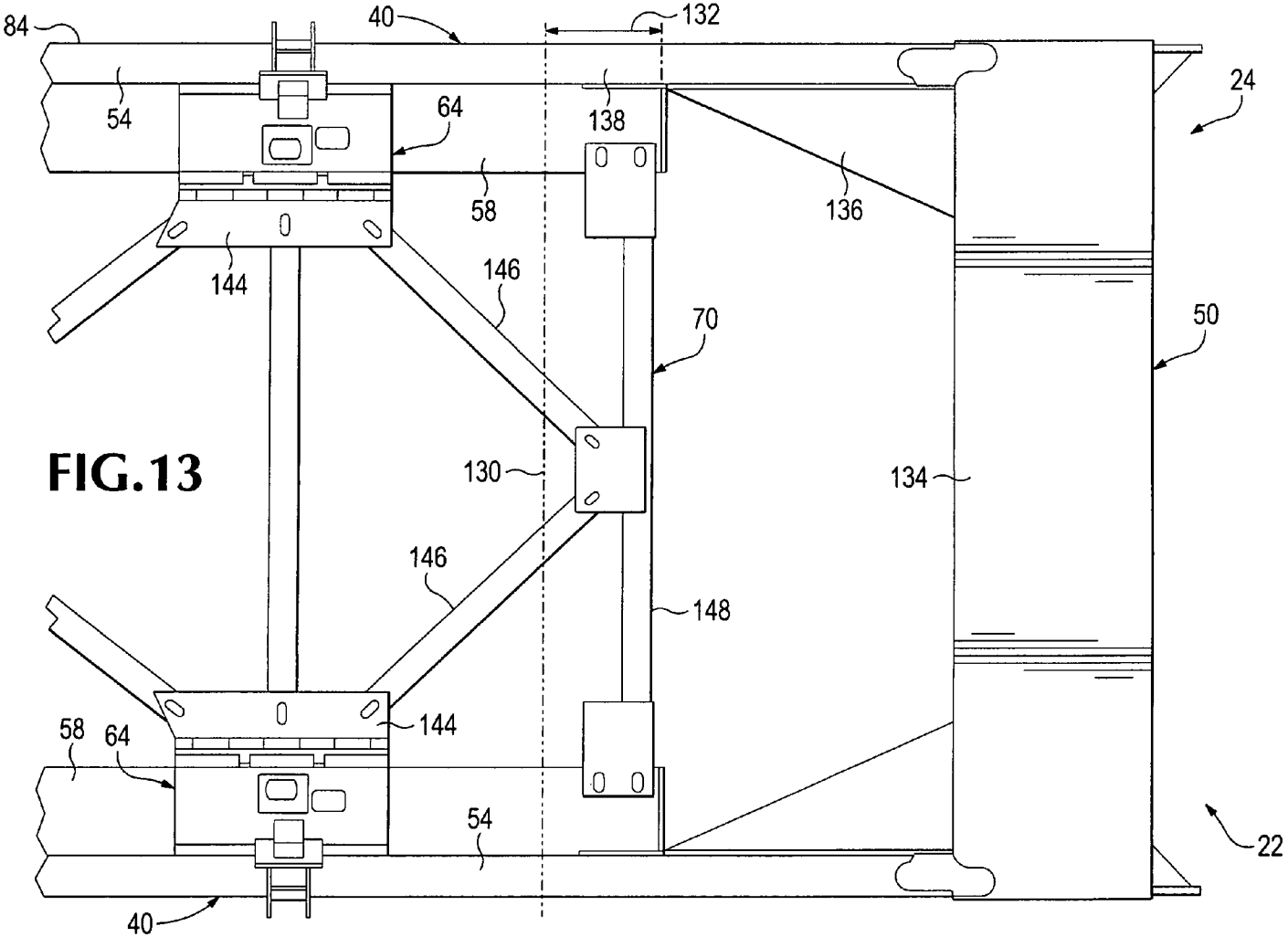

FIG. 13 is a top plan view of the coupler end portion of the container-well car end unit shown in FIG. 1.

Figure 14:
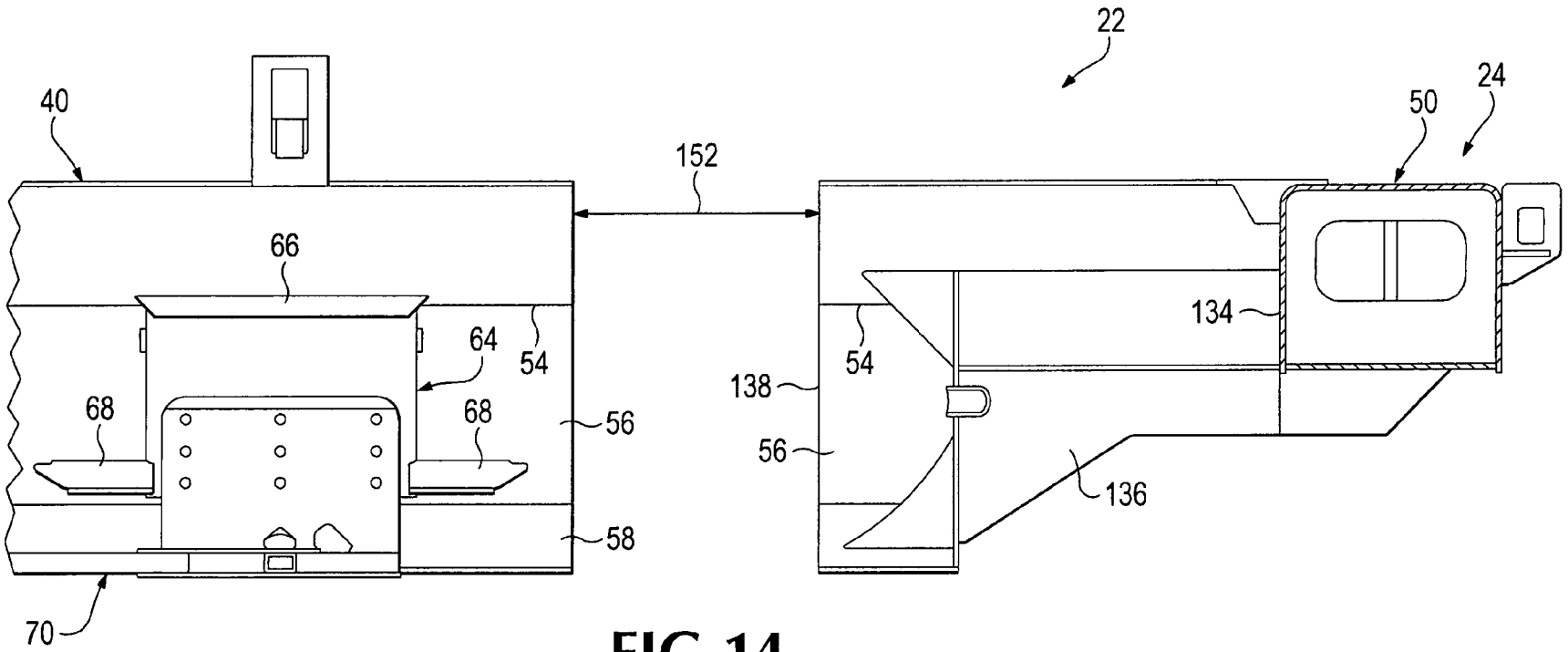

FIG. 14 is a view similar to FIG. 12, with the side sill of the portion of a well car unit shown cut and a coupler end portion of the car unit body separated from a longitudinally central portion of the car unit body as part of the process of lengthening the coupler end of the car unit.

Figure 15:
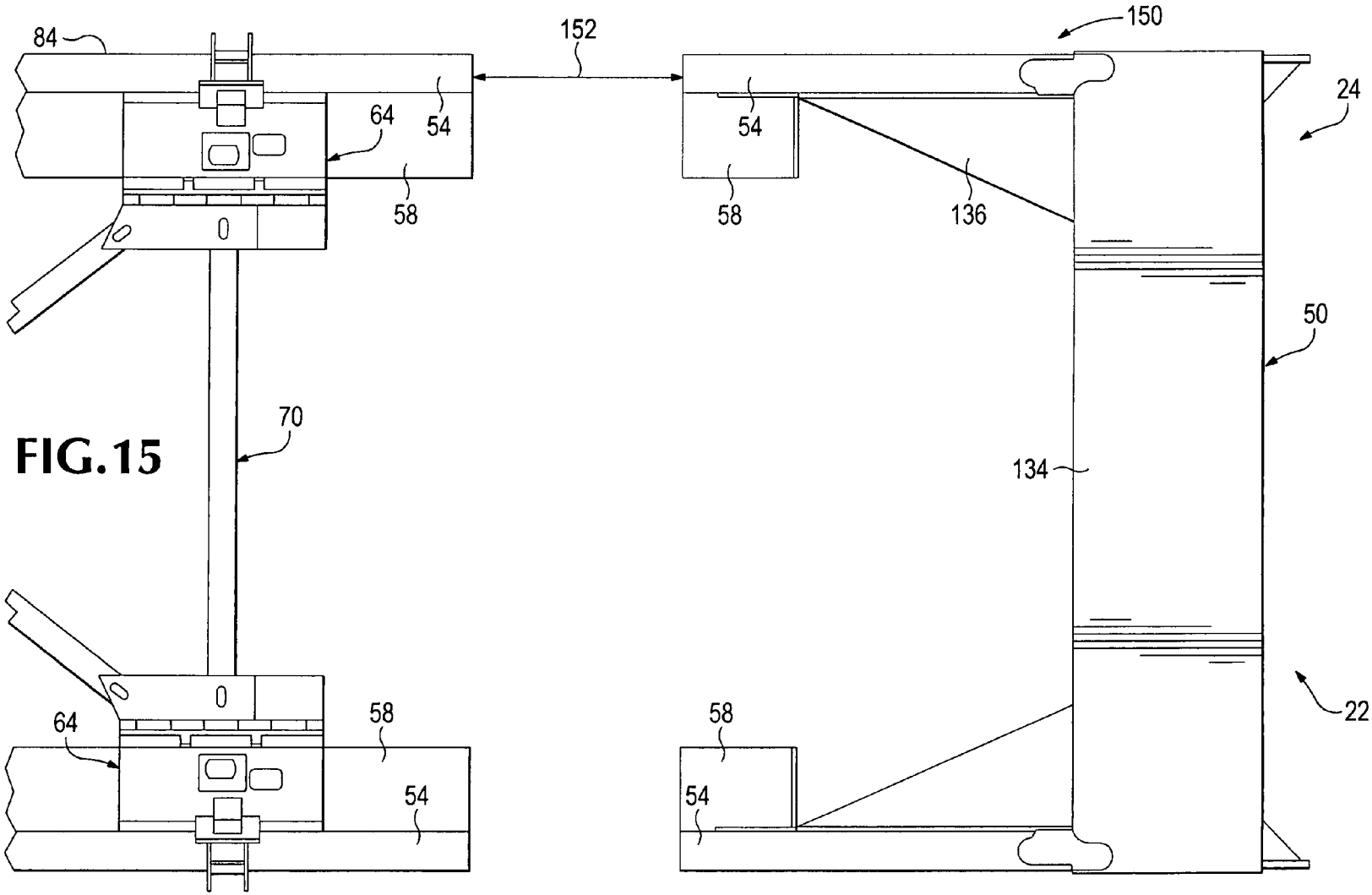

FIG. 15 is view similar to FIG. 13, but showing the condition of the coupler end portion of an end unit of a freight car after the side sills and a portion of the bottom support truss assembly have been cut away and the end portion of the car unit body has been moved away from the longitudinally central portion of the car unit body, as part of the process lengthening the coupler end of the car unit.

Figures 16, 17:
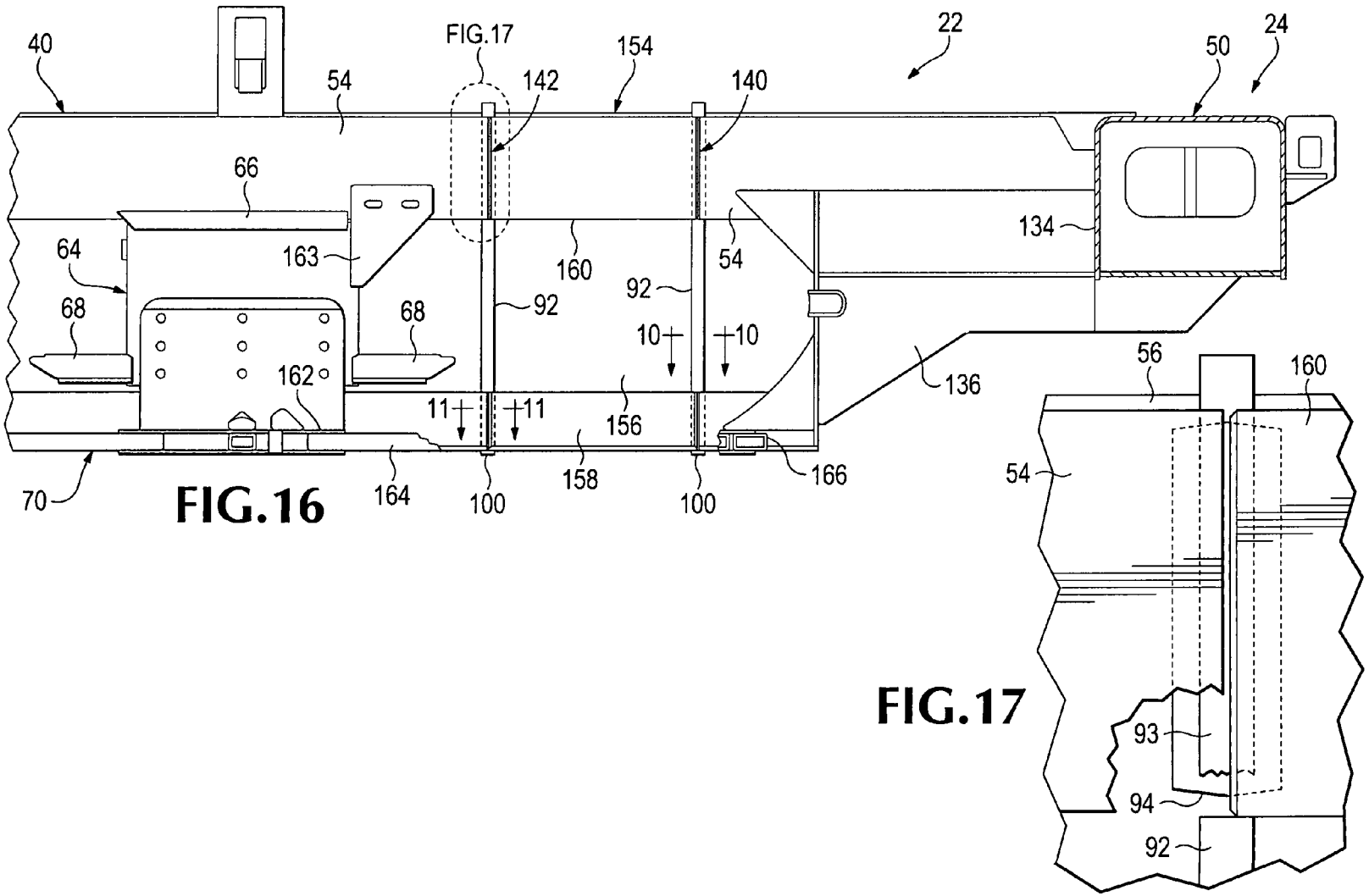

FIG. 16 is a side elevational view taken in the same direction as FIGS. 12 and 14, with a side sill extension portion installed between the coupler end portion and the longitudinally central portion of the well car end unit body, to lengthen the container well at the coupler end of the well car end unit.

FIG. 17 is a partially cutaway view of a detail of the portion of a body of a well car end unit shown in FIG. 16.

Figure 18:
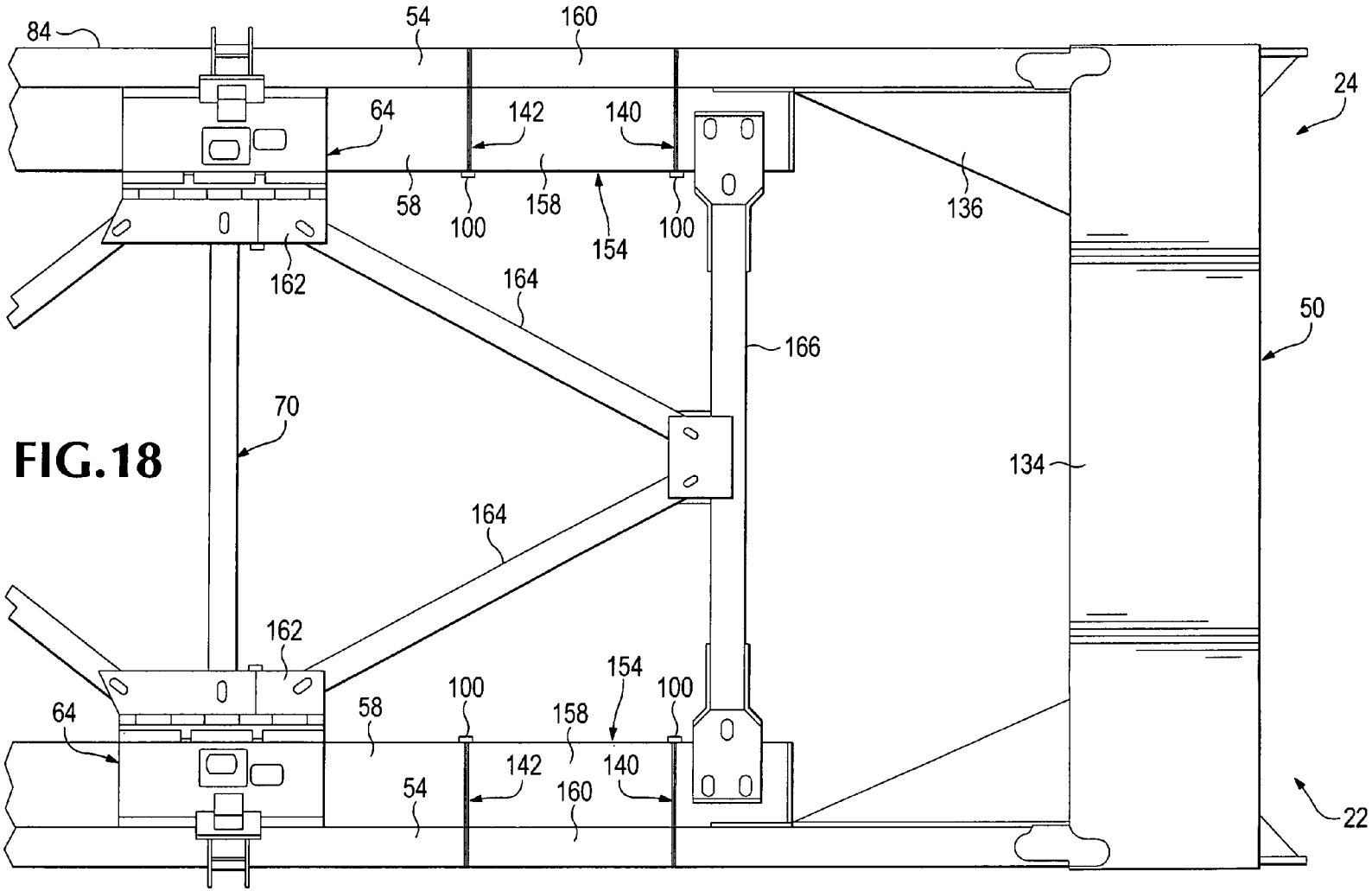

FIG. 18 is a top plan view similar to FIG. 13, with side sill extension portions installed between the coupler end portion and the longitudinally central portion of the car unit body and a revised portion of a bottom truss assembly installed between the container support assemblies and the body bolster to lengthen the container well at the coupler end of the well car unit.

Figure 2:
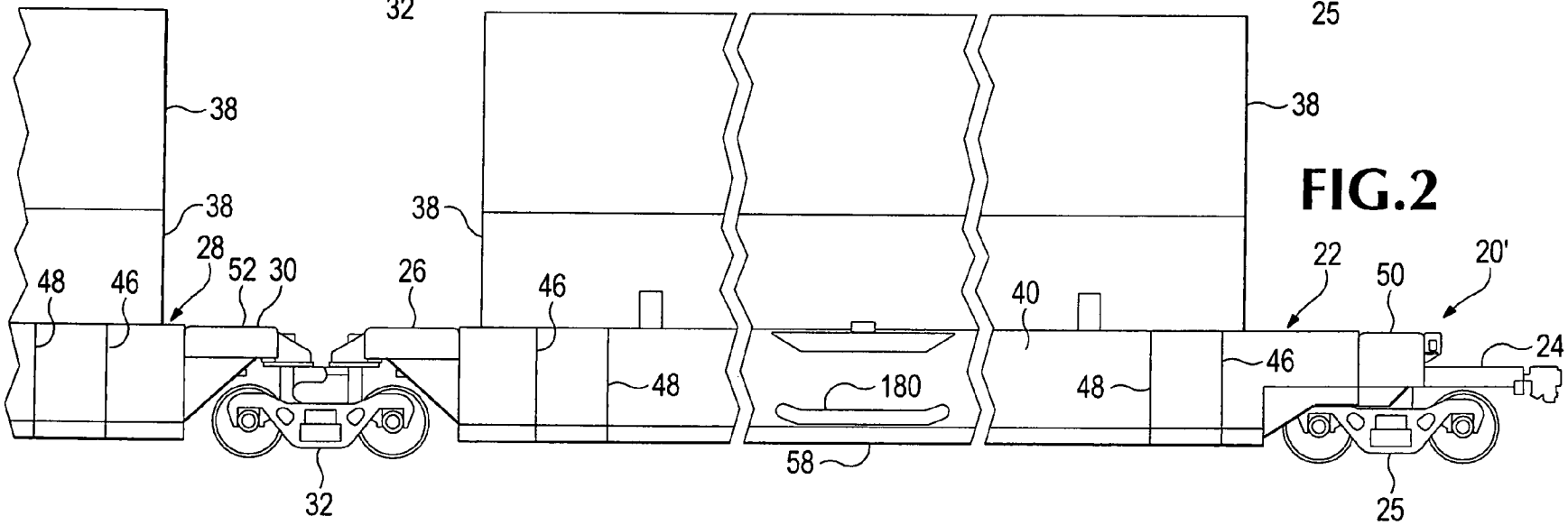
FIG. 2 is a foreshortened side elevational view of an end unit and a portion of an intermediate unit of the railroad freight car shown in FIG. 1, after conversion in which the separate units have been increased in length to receive intermodal freight containers of a longer standard size in the container wells.
Figure 19:
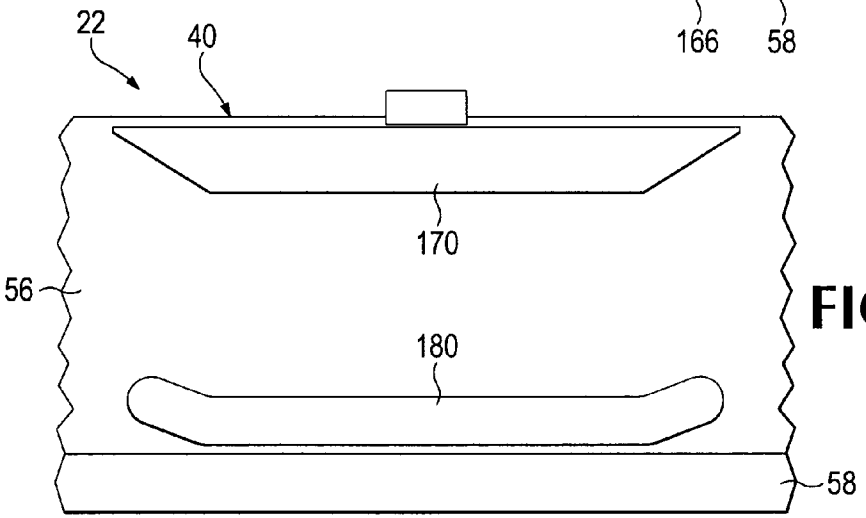

FIG. 19 is a side elevational view of a longitudinally central portion of the body of the well car end unit shown in FIG. 2, at an enlarged scale.

Figure 20:
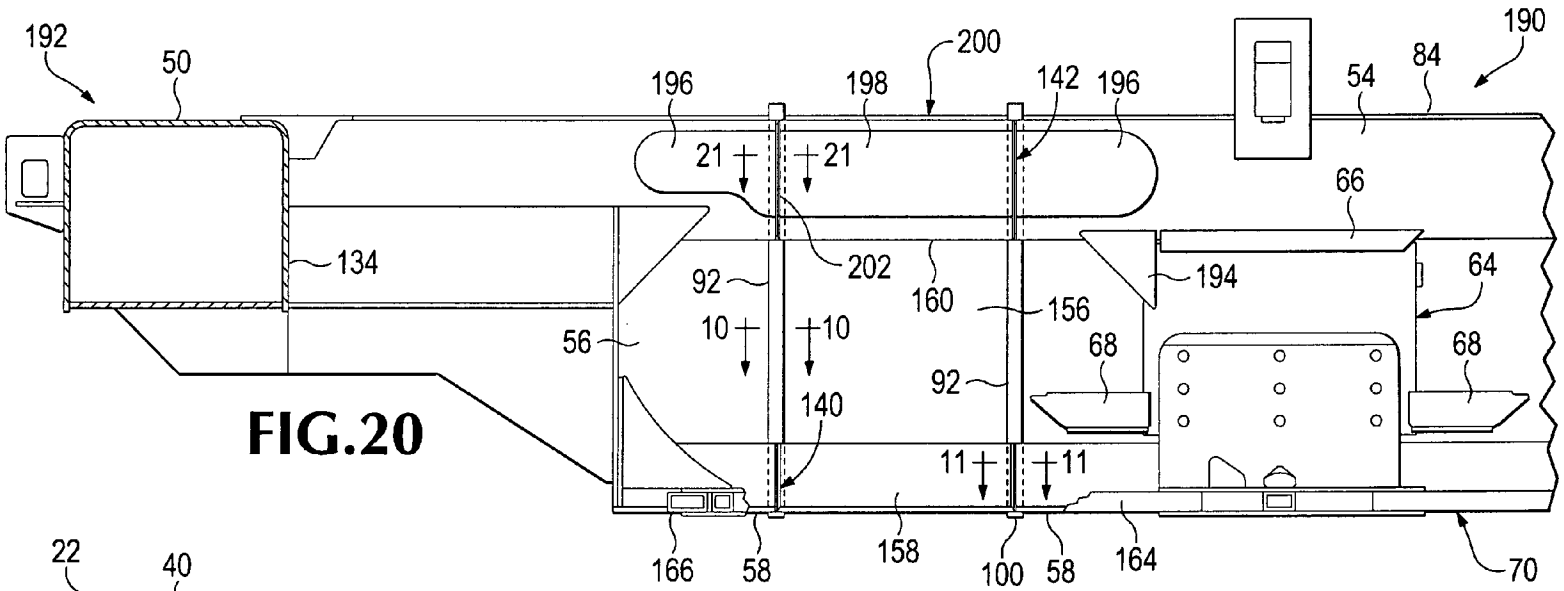

FIG. 20 is a side elevational view showing a side sill extension portion installed between a coupler end portion and the longitudinally central portion of a car body of a container-well car of a slightly different design, to lengthen the container well at one end of the car body.

Figure 21:
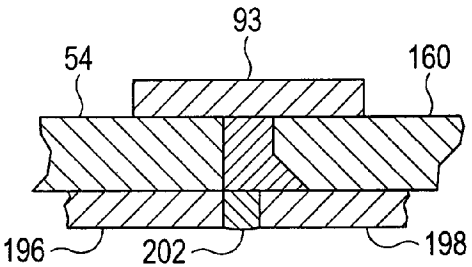

FIG. 21 is a sectional view of a detail, taken along line 21-21 in FIG. 20.

Figure 22:
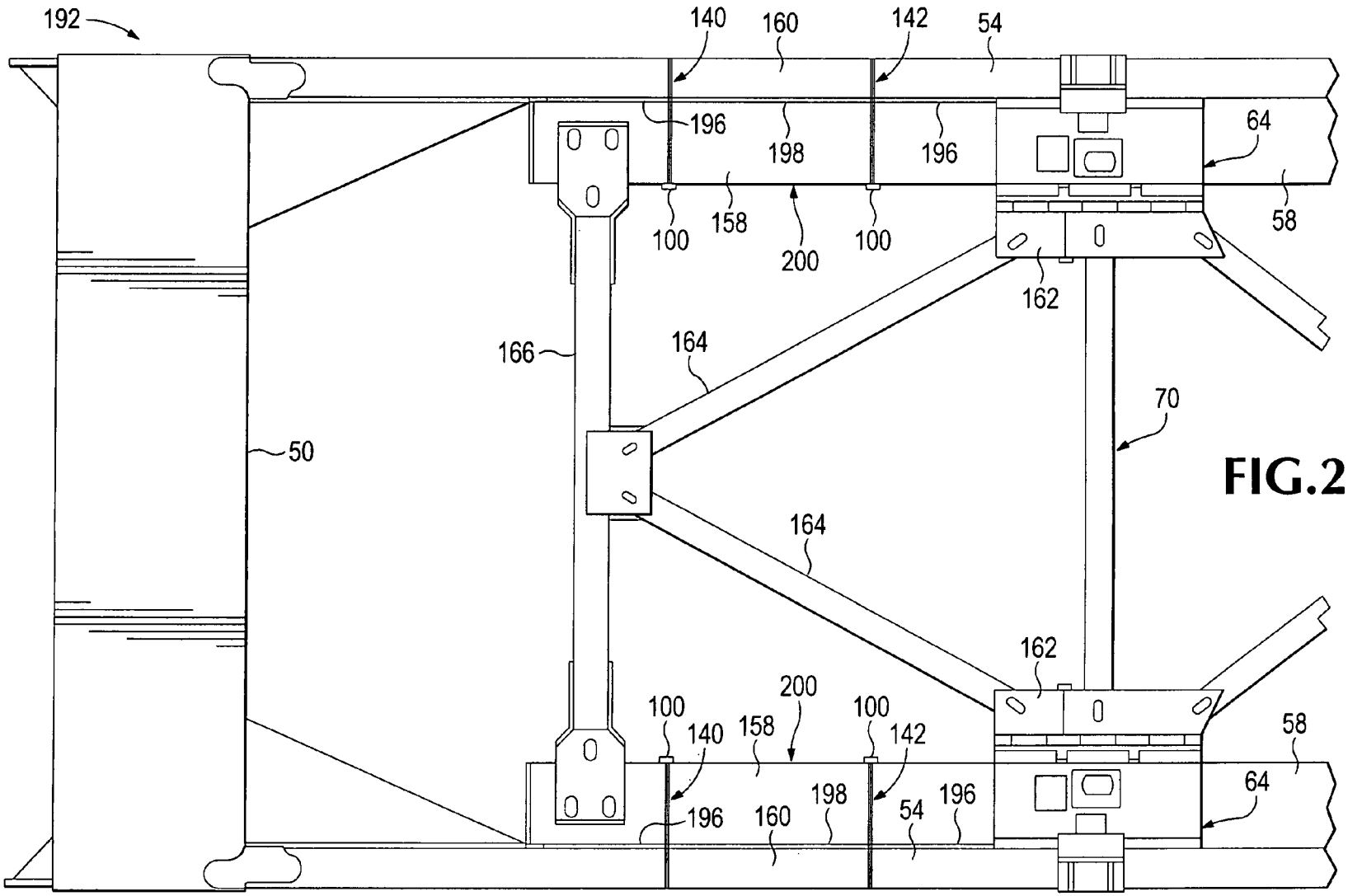

FIG. 22 is a top plan view of the coupler end portion of the body of the container-well car unit shown in FIG. 20, including a revised portion of a bottom truss assembly.

Figure 23:
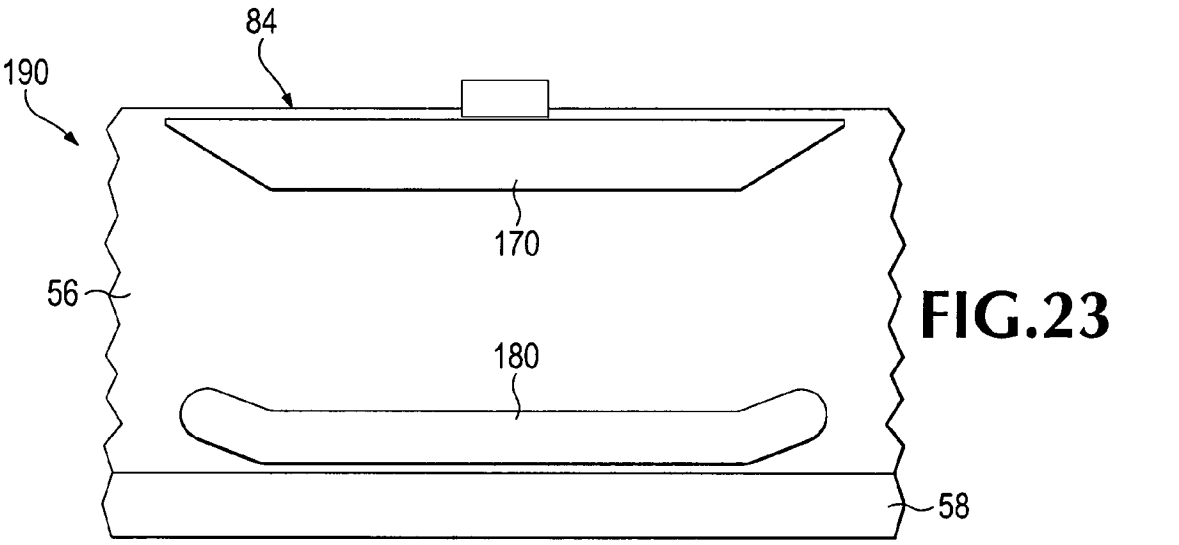

FIG. 23 is a side elevational view of a longitudinally central portion of the body of the container-well car unit whose coupler end is shown in FIG. 20.

Figure 24:
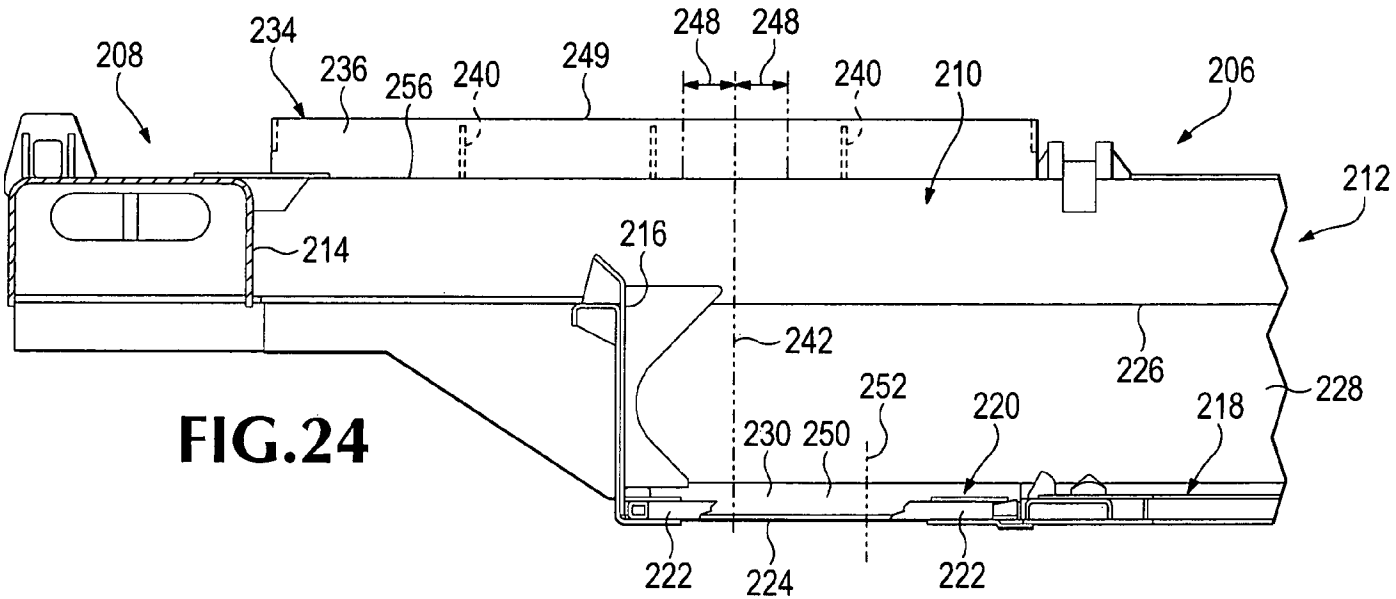

FIG. 24 is a side elevational view of a portion of a side sill of a container well adjacent a coupler end of a container-well car unit body, taken from within the container well and showing a body bolster of the car unit in sectional view.

Figure 25:
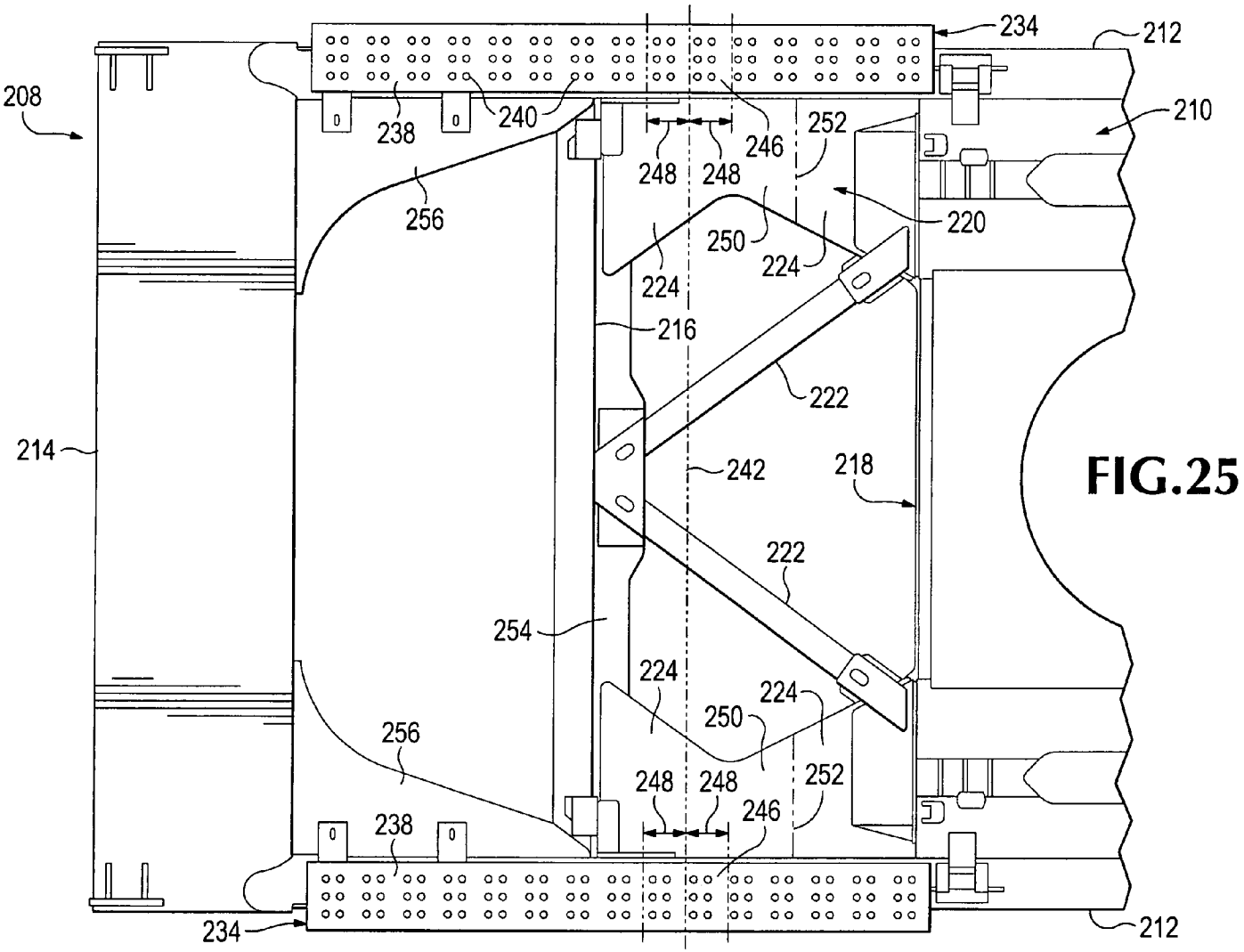

FIG. 25 is a top plan view of the coupler end portion of the container-well car unit shown in FIG. 24.

Figure 26:
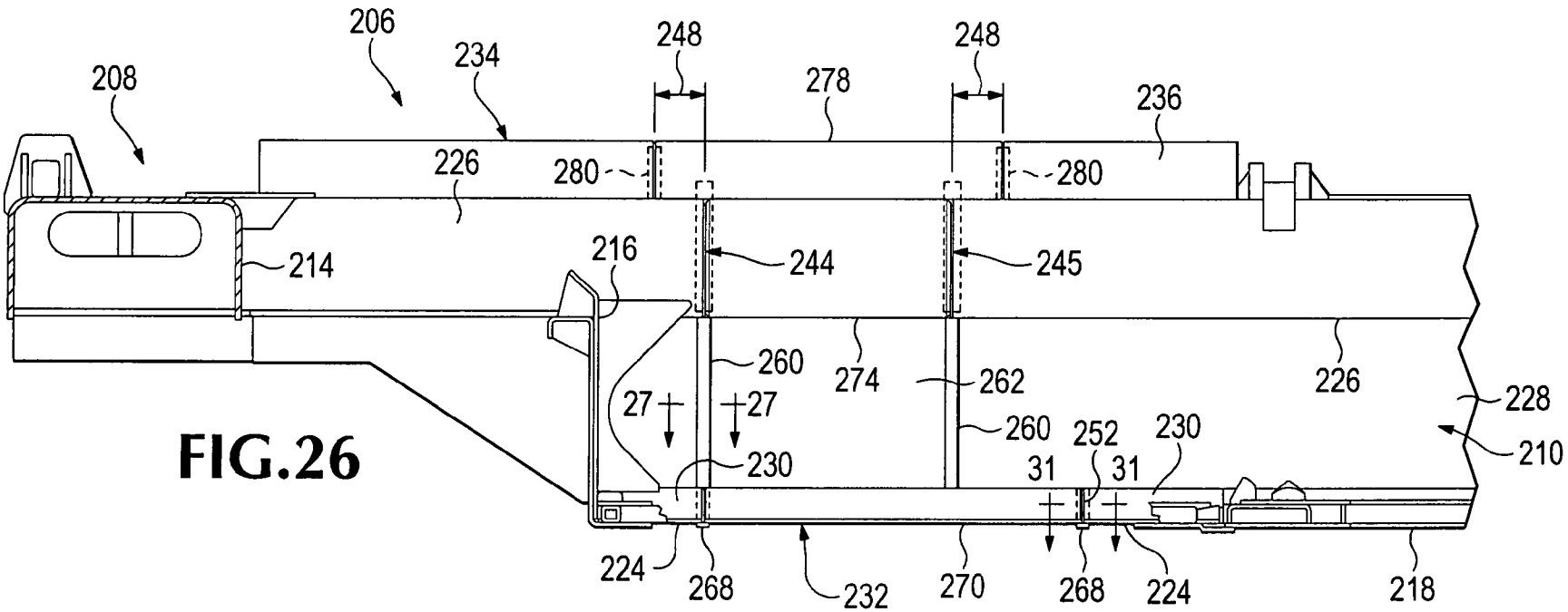

FIG. 26 is a side elevational view of the portion of a lengthened container-well car unit shown in FIGS. 24 and 25, taken from within the container well and showing the body bolster of the car unit in sectional view.

Figure 27:
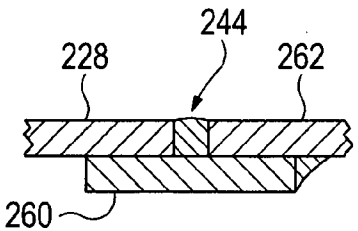

FIG. 27 is a sectional view of a detail, taken along line 27-27 of FIG. 26.

Figure 28:
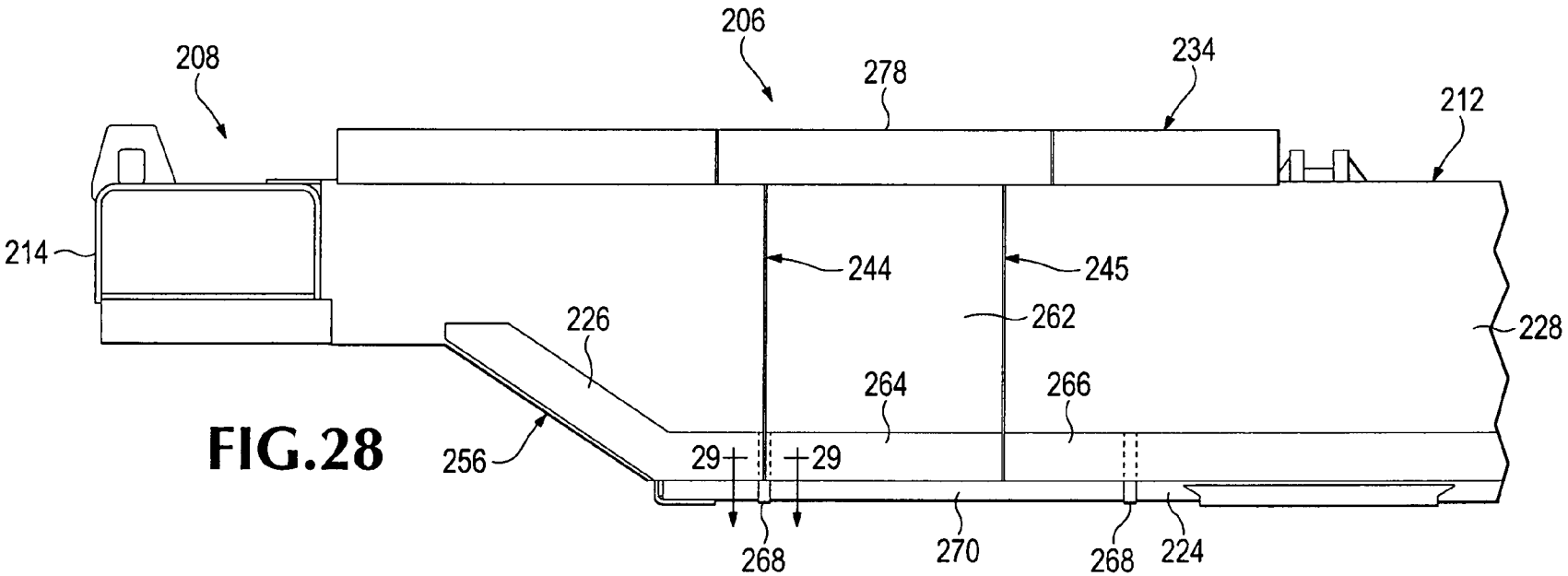

FIG. 28 is a side elevational view of the portion of a container-well car unit shown in FIGS. 24 and 25, with a side sill extension portion installed to lengthen the container well at a coupler end of the well car unit.

Figure 29:
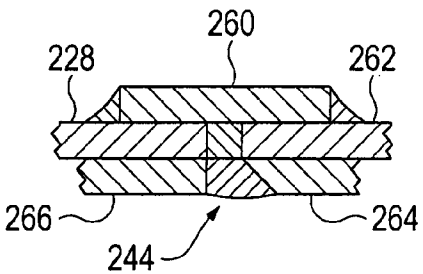

FIG. 29 is a sectional view of a detail, taken along line 29-29 of FIG. 28.

Figure 30:
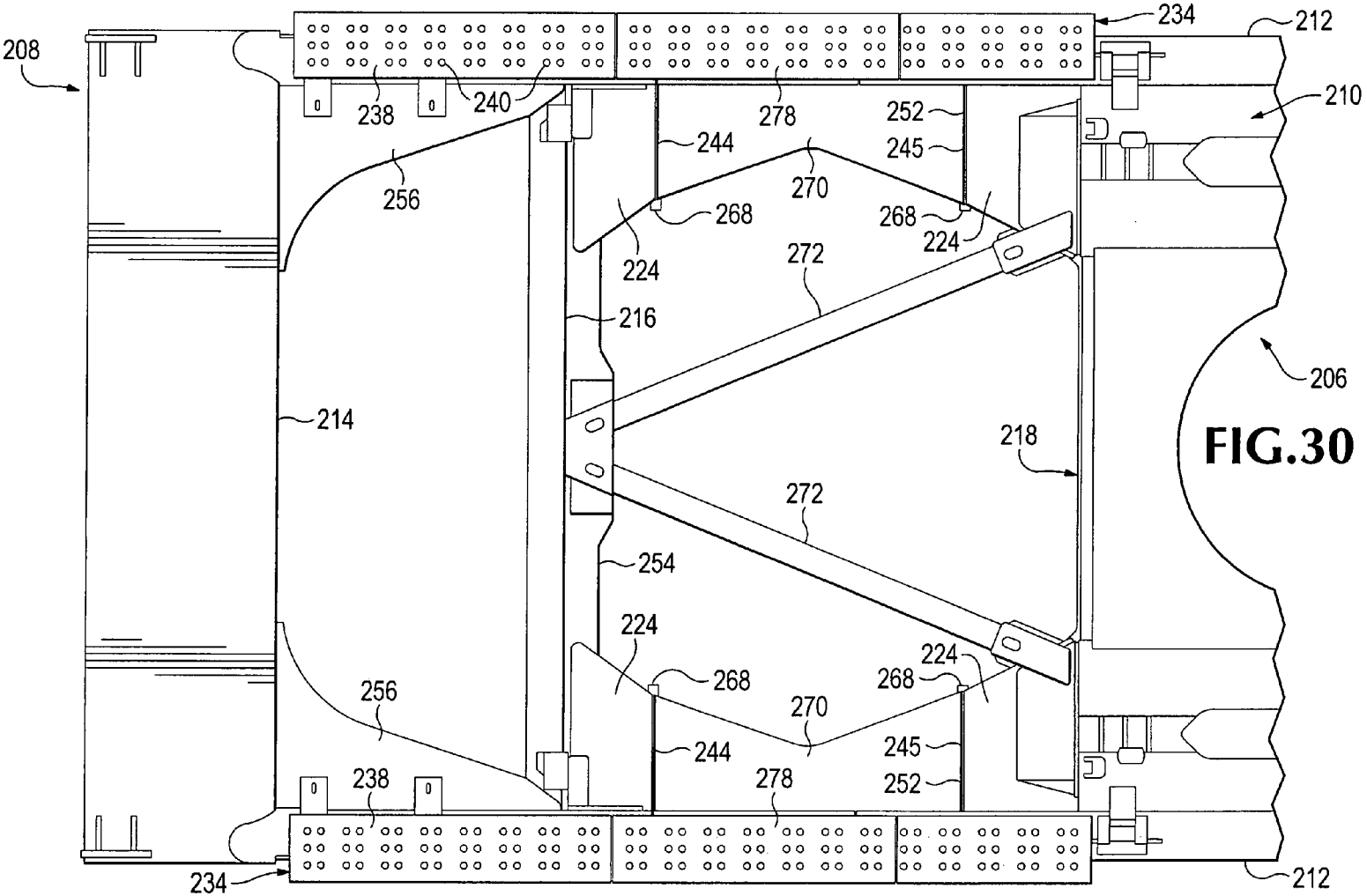

FIG. 30 is a top plan view of the portion of a lengthened container-well car unit shown in FIGS. 26 and 28.

Figure 31:
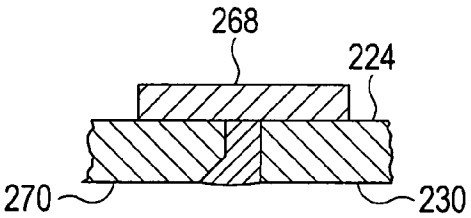

FIG. 31 is a sectional view of a detail, taken along line 31-31 of FIG. 27.

Figure 32:
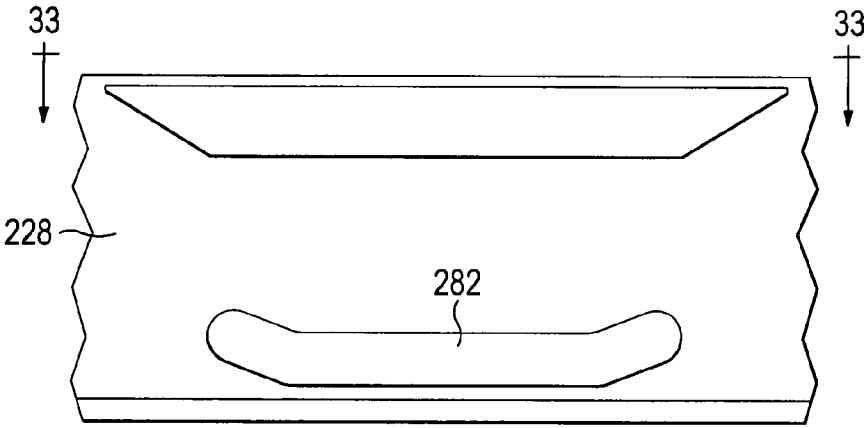

FIG. 32 is a side elevational view of a longitudinally central portion of the car body of which a portion is shown in FIGS. 24-27.

Figure 33:
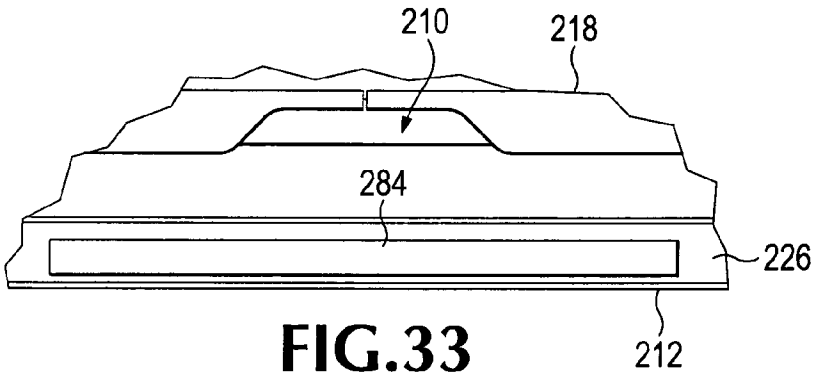

FIG. 33 is a top plan view of the portion of a car body shown in FIG. 32, taken in the direction of the line 33-33 in FIG. 32.

DETAILED DESCRIPTION OF EMBODIMENTS

Referring now to the drawings which form a part of the disclosure herein, in FIG. 1 a portion of a multi-unit railroad container-well car 20 for carrying intermodal cargo containers includes an end container well car unit 22 that has an outer or coupler end 24 supported on a wheeled truck 25, and an intermediate end 26. An intermediate container-well car unit 28 is coupled to the intermediate end 26 of the end unit 22, and an intermediate end 30 of the intermediate unit 28 and the intermediate end 26 of the end unit 22 are supported together on a shared truck 32. The well car 20 may have additional intermediate units (not shown) similar to the intermediate unit 28, as well as another end unit (not shown). Alternatively, a container-well car may have only a single unit, with two opposite coupler ends similar to the coupler end 24 shown in FIG. 1. As a further alternative, a multi-unit container-well car might have only two end units similar to the end unit 22, interconnected at an intermediate end 26 of each.

The multi-unit car 20 is shown laden with a nominal 48-foot intermodal freight containers 34 carried in a lower tier of a respective container well 36 defined between the opposite side sills 40 of the end unit 22 and between the opposite side sills 42 of the intermediate unit 28. A 53-foot container 38 is stacked upon and locked to the lower container 34 in each container well 36. The container well 36 of each well car unit 22, 28 receives the lower container 34 with no room to spare at either end of the container 34, as shown in FIG. 1, since the container wells 36 are designed to receive nominal 48-foot containers 34 occupying the entire length of the container well of each well unit 22 or 28, or to receive shorter, nominal 40-foot containers 44 (shown in broken line) with extra room left at each end of the respective container well 36.

For the economic reasons explained above, it is desirable to convert a container-well car unit of such a multi-unit car 20 to a longer configuration in which a container well is capable of carrying a 53-foot container 38, and is not limited to a 48-foot container 34 or a 40-foot container 44, or a pair of 20-foot containers (not shown). Accordingly, the car units of the multi-unit car 20' shown in FIG. 2 have been lengthened as will be described herein presently, by adding an extension section about 2½ feet long to each side sill 40 and 42, at each end of each container-well car unit 22 and 28, joining the extension sections to each side sill 40 and 42 at respective seams 46 and 48, revising a container-well bottom truss assembly, and by making changes to the side sill structure to ensure sufficient rail clearance height at mid-length.

The side sills 40 of the end unit 22 are interconnected by a transversely extending body bolster 50 at the coupler end 24 and by a transversely extending body bolster 52 at the intermediate end 26. A respective body bolster 52 interconnects the side sills 40 of each intermediate unit 28 at each of its intermediate ends 30.

Referring next to FIG. 3, the intermediate end 26, including a portion of a side sill 40 of the end unit 22, is shown as in the multi-unit car 20 before conversion to lengthen of the container well from a 48-foot container capacity to a 53-foot container capacity. The side sill 40 includes a top chord 54 in the form of a deep box beam, or deep tube, structure, including an outwardly-facing channel 54 welded to the laterally inner face of a web plate 56. The web plate 56 extends downward beneath the top chord channel 54, and a lower part of it is angled diagonally inward and connected to a bottom chord member 58 of heavier plate material bent into a form resembling an "L" with its horizontal portion directed laterally inward with respect to the container well.

A large reinforcing plate 60 and a doubler plate 62 extend vertically along the inboard, or container well, side of the side sill 40, between the body bolster 52 and a container support assembly 64 welded to the side sill 40. Attachment of the container support assembly 64 to the side sill 40 includes a bridge plate 66 welded to the top chord 54 and a reinforcing member 68 extending along a portion of the inboard face of the web plate 56.

A container-well bottom truss assembly 70 extends horizontally between the two opposite side sills 40 at the bottom of the container well 36, and extends longitudinally to the end of the container well 36, adjacent the body bolster 52. A vertical gusset 72, shown only in edge view in FIG. 3, extends transversely at the end of the container well.

To prepare for lengthening the container wells 36, the body of each well car unit 22 and 28 is supported on suitable stands (not shown) and separated from the wheeled trucks 25 and 32. Suitable cable or chains may be fastened temporarily to the tops of the side sills 40, extending transversely across the top of the container well 36 to maintain its width. Referring to FIGS. 3 and 4, at the intermediate end 26 of each end unit 22, and at each intermediate end 30 of each intermediate unit 28, the reinforcement plate 60 may be carbon air arced free from the container support assembly 64, the top chord 54, and the lower, inwardly-inclined part of the web plate 56 of the side sill 40. A portion 76 of the reinforcement plate 60 nearer to the container support assembly 64 and having a width 78 may be cut away along a vertical line 80 shown in FIG. 3, and a portion 82 of the horizontal truss assembly 70, shown in FIG. 4, may be removed from between the container support assembly and the body bolster 52.

With the intermediate end 26 of the end unit 23, including the body bolster 52, supported on a suitable dolly that can be moved longitudinally away from the longitudinally central portion 84 of the body of the container car end unit 22, the top chord 54, the web plate 56, and the bottom chord 58 may be cut along a vertical plane 86, leaving the portion of the car shown in FIGS. 3 and 4 in the condition shown in FIGS. 5 and 6, in which the body bolster 52 and the attached, immediately adjacent portions of the side sills 40 are free to be moved with respect to the central portion 84 of the body of the end unit 22. The cut edges of the car body portions may be ground flat and smooth.

The location of the vertical plane 86 at which the side sills 40 are cut is a distance 87 from the body bolster 52, determined to permit a side sill extension portion 88 to be inserted with an inboard first connecting joint 48 located longitudinally outboard and clear of the location of the container support assembly 64 and an outboard second connecting joint 46 closer to the body bolster 52. The distance 87 may thus be no greater than about 3 feet and may advantageously be about 33 inches.

Carried on a suitable wheeled dolly, for example, or otherwise movably supported, the body bolster 52 and the attached reinforcement plates 60 and end portions of the side sills 40 are moved longitudinally a distance 89 away from the longitudinally central portion 84 of the body of the end unit 22. A pair of mirror opposite side sill extension portions 88 are aligned with the corresponding spaced-apart portions of the other side sill 40, with a small gap left for properly welding the corresponding parts together to form the connecting joints 46 and 48 in each side sill 40. Thus to increase the length of the car body 22 by 30 inches the distance 89 may be 31 inches and each side sill extension portion 88 may have a length 90 of about 30 inches, great enough to add to the length of the container well 36 about 30 inches, half the increase in the length of the container well 36 needed to accept a 53-foot container supported on and located by the container support structures 64 originally present within the container well 36.

The side sill extension portions 88 may be prepared by welding a top chord channel extension portion 98 and a bottom chord plate extension portion 102 to a web plate extension portion 96. A backing bar 93 may be welded to the interior of the top chord channel extension 98 at each end of the side sill extension 88. A backing bar plate 94 may also be welded to the laterally inner face of each cut end of the web 56 at a position aligned with the interior of the top chord channel 54. The backing bar 94 may be wider than the backing bar 93 and may have sloping end surfaces in order to help align the sill extension portion 88 during installation. With both the longitudinally central portion 84 of the car unit body and the end portion of the car unit including the body bolster 52 supported on suitable stands and aligned with each other at a distance greater than the required spacing distance 89, the side sill extension portion 88 is moved into place and aligned with the remaining margins of the end portion of the cut side sill 40 along the end plane 86 and tack welded to the original parts of the web plate 56 along the exterior of the side sill 40, as shown in FIG. 10, and to the top chord channel 54. Backing bars 92 may then be welded to the side sill web 56 on the end portion and to the web plate extension 96 along the cutting plane 86, and the backing bar 92 may also be welded to the laterally inner face of the web plate extension portion 96. The end portion of the car unit body, with the side sill extension 88 tack welded in place, may then be moved toward the longitudinally central portion 84 to align the side sill extension 88 with it and then to tack weld it to the exposed margins of the side sill 40 there. Another backing bar 92 may be welded to the laterally inner surfaces of the side sill web plate 56 and the web plate extension 96. The web plate extension portion 96 may then be welded to the margins of the web plate 56 on the exterior of the side sill 40 in the locations where the doubler plates 92 and 94 are located, and the ends of the top chord channel 98 may be welded to the top chord channel 54 of the original side sill 40.

Backing bars 100 may be welded to the exterior and bottom surfaces of the cut bottom chord plate 58 of the side sill 40 along the margins of the end portion and the longitudinally centrally located portion 84. The bottom chord extension portion 102 may be welded to the margins of the cut bottom chord plate 58, along the backing bars 100, as shown in greater detail in FIG. 11, forming a secure weld joint 103 in the bottom chord.

A container support assembly reinforcement member 110 may be welded into position to interconnect the container support assembly 64 with the side sill extension portion 88 along the interior face of the web plate extension portion 96. Similarly a gusset plate 112 may be welded into position on the laterally inward face of the top chord channel extension portion 98, bridging the joint between the top chord channel 54 in the longitudinally central portion of the side sill 40 and the top chord channel extension portion 98, as well as being welded to a laterally inward face of the container support assembly 64, as may be seen in FIG. 7.

A closer plate 104 extending vertically and transversely of the body of the car unit 22 may be installed between the laterally inner face of the web plate 56 and the cut margin 106 of the larger enforcement plate 60. A gusset 108 may be installed parallel with the reinforcement plate 60, between the closer plate 104 and the bottom chord 58, bridging the outboard connecting seam 46 where the bottom chord extension portion 102 is joined to the original portion of the bottom chord plate 58 in the end portion of the car unit.

To restore the well bottom truss assembly 70 a transversely extending beam member 118 is fastened to the bottom chord 58 through attachment plates 120 a small distance from the main transverse member of the body bolster 52. A pair of diagonal tubes 122 are connected to the beam member 118, through joining plates 124 located centrally of the width of the container well 36, and extend to hinge plates 126 on the container support assemblies 64 to bridge the additional distance resulting from the installation of the side sill extension portions 88. The hinge plates 126 may be replacements of relevant portions of original hinge plates removed in connection with removal of the portions 82 of the container well bottom truss assembly 70.

While extension of the side sills 40 at the intermediate end 26 has been described and shown in FIGS. 3, 5, and 7 on only one side of the container well 36, the procedure is similar on the opposite side sill 40 and thus need not be described in detail. Also, the lengthening of the container well 36 at the intermediate end portion 30 of each intermediate unit 28 is performed substantially similarly to the shortening of the container well at the intermediate end 26 of the end unit 22, as just described, and thus need not be discussed in detail.

The coupler end 24 of the container-well end unit 22 of the multi-unit car 20 is prepared for lengthening of the container well 36 by a procedure generally similar to that described above with respect to the intermediate end 26. The top chord channel 54, side sill web plate 56, and bottom chord plate 58 may be cut along a cut plane 130, located at a distance 132 from the end of the container well 36. The distance 132 may be advantageously determined to place the end plane 130 some distance from the end of the container well 36 and from the container support assemblies 64 to avoid stress concentrations and so that the side sills 40 may be cut where there are no particular complexities in their structure. Thus the distance 132 may be in the range of 1-3 feet and may preferably be around 15 inches.

In connection with cutting the coupler end 24 along plane 130, a portion 144 of a hinge attachment of a diagonal member 146 of the bottom truss assembly 70 may be removed, as well as the diagonal members 146 and the transverse member 148 and the plates by which it was attached to the bottom chord 58 of each side sill 40 to allow an extension of the truss assembly 70 to be installed. The body bolster 50 and the attached short end portions 136 of both side sills 40 are thereafter moved longitudinally away from the remaining longitudinally central portion 84 of the body of the end unit 22, in much the same fashion as described above with respect to the intermediate end 26, in order to fasten side sill extension sections 154 between them along connecting seams 140 and 142.

The plane 130 along which the coupler end 24 of the end unit 22 is cut is thus located in the least complex portion of the coupler end 24 and does not require any disturbance of the container support assemblies 64, the bridge plate 66 connecting it with the top chord 54, or the reinforcement assembly 68 connecting it with the side sill web member 56.

As may be seen in FIGS. 14 and 15, the end portion 150 at the coupler end 24 of the end unit 22 is moved away from the longitudinally central portion 84 of the end unit car body in order to permit installation of extension portions 154 into both of the side sills 40 at the coupler end 24 of the end unit 22 with a final separation distance 152 of about 31 inches.

Side sill extension portions 154 may be assembled as with the side sill extension portions 88, with a top chord channel extension 160 and a bottom chord extension plate 158 welded to a web member extension portion 156. Backing bars 93 and 94 may also be similarly installed. Installation of the extension portions 154 may be generally similar to installation of the side sill extension portions 88 at the intermediate end 26 of the body of the end unit 22, described previously. That is, as at the intermediate end 26, the coupler end portion 150 is supported and the side sill extension portions 154 are aligned precisely with end portion of each side sill 40 as each side sill extension portion 154 is tack welded into place and a backing bar 92 is welded in place along the portions of each connection seam 140 along the mating edges of the web member 56 of the respective side sill 40 in the end portion 150 and the web member extension portion 156 of the side sill extension section 154. The top chord channel extension portion 160 may also be tack welded to the adjacent top chord channel portion 98. Backing bars 100 are used in joining the bottom chord portion 158 to the bottom chord portion 58 of both the end portion 150 and the longitudinally central part 84, incorporating a weld joint such as that shown in FIG. 11, described above.

With the side sill extension portion 154 tack welded in place on each side sill 40 of the end portion 150, the attached end portion 150, together with the side sill extensions 154, may be moved toward and aligned with the longitudinally central portion 84, where the side sill extension portions 154 may be tack welded to the side sills 40 along the inward connecting seams 142. Backing bars 92 and 100 may be welded into position, and the weld joints may be completed along the exterior of the connecting seams 140 and 142 as shown in detail in FIG. 10 and along the ends of the top chord channel extension portion 160 and the bottom chord plate extension position 158 as shown in FIG. 11. A connecting plate 163 may be added to strengthen the connection between the container support assembly 64 and the top chord channel 54.

As shown in FIG. 18, the removed hinge portions 144, diagonal members 146, and transverse member 148 of the well bottom truss assembly 70 are replaced with generally similar hinge portions 162, diagonal members 164 of greater length, in order to span the additional length of the side sill extension sections 137, and a replacement transverse member 166, to provide a container-well bottom truss assembly 70 revised to fit the extended length of the container well at the coupler end 24 of the end unit 22.

With the container well 36 lengthened at each end as described above, the wheeled trucks 25 and 32 supporting the end unit 22 are separated from each other by a greater distance, making it more critical that sufficient clearance is provided beneath the car body at mid-length. Accordingly, the body bolsters 50 and 52 of the end unit 22 are either supported on the trucks 25 and 32 or otherwise supported at the same height after the end unit 22 has been lengthened as described above. The clearance height beneath the mid-length section of the car body is measured, and, if necessary, the side sills 40 on each side are raised with respect to the body bolsters to provide the required clearance.

With the 50 and 52 car unit thus supported, a trapezoidal reinforcement plate 170 may be welded to the exterior of the side sill 40 at mid-length, near the top of the side sill and aligned with the top chord channel 54. Additionally, a reinforcement plate 180 may be welded to the exterior of the web plate 56 above the bottom chord plate 58, as shown in FIG. 19. The process of welding the reinforcement plates 170 and 180 into place has the effect of heating the side sill 40 at mid-length, and after having been heated by the process of welding the reinforcement plates 170 and 180 to the web plate 56 of the side sill 40 the subsequent shrinkage as the assembly cools while supported has the effect of introducing an additional amount of camber into the side sill 40 to increase and retain additional clearance height beneath the mid-length portion of the car unit body.

Referring next to FIGS. 20-23, a car body 190 of a single-unit container-well car shown in a lengthened condition has a pair of opposite, similar, coupler ends 192, each generally similar to the coupler end 24 of the end unit 22 of the multi-unit car 20 described above. The process of lengthening the car body 190 is essentially similar to the process of lengthening the coupler end 24 of the end unit 22 at each of the opposite ends, with the exception of minor structural differences, and so similar reference numerals are utilized in description of the lengthened car body 190, apart from those differences. One difference is that a triangular reinforcing plate 194, present in the car body 190 in its 48-foot container well configuration, is retained in the lengthened car body. As another difference, an oblong reinforcement plate 196 extends along an inner face of the top chord channel 54 in its 48-foot container well configuration, and an extension portion 198 is included in each side sill extension portion 200 added to each side sill 40 of the car body 190 in the process of lengthening the container well to accept 53-foot containers. The extension portion 198 of the reinforcement plate 196 is added after installation of the top chord channel portion 160, using, for example, a weld joint 202 as shown in FIG. 21 with respect to the longitudinally outboard connecting seam 140. The weld joint arrangement may be the mirror opposite of FIG. 21 for the inboard connecting seam 142, as will be understood.

As at the coupler end 24 of the end unit 22, hinge replacement portions 162, diagonal truss members 164, and a transverse truss member 166 are provided to revise the container well bottom truss assembly 70, as may be seen in FIG. 22.

The same procedure and structure may be utilized at the opposite end of the car body 190, and thus there is no need to provide additional detailed description or drawings thereof.

As shown in FIG. 23, a trapezoidal reinforcement plate 170 and a reinforcement plate 180 are added to the exterior of the side sill 40 on each lateral side of the car body 190 at mid-length in order to maintain or create additional camber in the side sills 40 to ensure the required clearance height beneath the car body 190 in its lengthened configuration.

Referring next to FIGS. 24 and 25, in a single unit container-well car of another similar, but somewhat different, construction a car body 206 has two opposite, similar, coupler ends 208, between which is located a container well 210 originally built to receive a 48-foot intermodal cargo container between a pair of deep side sills 212 of construction generally similar to that of the side sills 40 and 42 described previously. The side sills 212 are connected at each end of the car body to a body bolster 214 which extends transversely and rests on a wheeled truck such as the truck 25 shown in FIGS. 1 and 2. The car body 206 is shown herein without any couplers attached to the car body, and the car could be equipped with a fifth wheel trailer hitch, as is shown in U.S. Pat. No. 5,611,285, which discloses a container-well car of similar construction. As explained in greater detail in U.S. Pat. No. 5,611,285, a transverse vertical plate 216 defines the end of the container well 210, which is long enough to receive a 48-foot intermodal cargo container.

A container well floor assembly 218 extends horizontally between the side sills 212 over a portion of the container well extending longitudinally about 42 feet, and a transition portion 220 of the bottom of the container well 210 includes a pair of diagonal beams 222 and a pair of transition plates 224 extending from the floor assembly 218 toward the container well end member 216. Each of the transition plates 224 extends along and is joined to the bottom of one of the side sills 212 in the transition portion 220 and extends laterally inward toward the middle of the width of the container well 210.

Each side sill 212 includes a top chord channel member 226 whose flanges face outwardly and are welded to the inboard side of a side sill web plate 228. A diagonally upwardly extending flange portion 230 of each of the transition plates 224 is fastened to a lower margin of the side sill web plate 228, so that the transition plate 224 acts as a bottom chord for the portion of the side sill 212 along which it extends.

Welded to the top of each side sill 212 and extending longitudinally from about the end of the floor assembly 218 to the body bolster 214 is a side sill reinforcing structure 234 including a main member in the form of a channel having the shape of an inverted "U" with a generally vertical inboard leg 236, a generally horizontal top 238, and an outboard leg that is inclined downwardly and inwardly to the top of the side sill web plate 228, so that the top 238 is wider than the side sill 212, as may be seen in FIG. 25. The top, horizontal, portion 238 of the side sill reinforcing structure 234 may be perforated as at 240, or may be otherwise provided with a non-skid surface, so as to serve as a walkway. Stiffener plates 240 extend transversely within the side sill reinforcing structure 234.

As with the previously described well car units 22 and 190 the container well 210 may be extended to be able to accept a 53-foot intermodal cargo container 38 by cutting the side sills and the bottom structure and inserting extension portions at each of the opposite ends of the car body 206. In particular, as may be seen in FIG. 27 the side sill top chord channel 226, the side sill web plate 228, the flange 230, and the transition plate 224 are all cut along a cut plane 242 that defines an outboard connecting seam 244, shown in FIGS. 27 and 28.

A section 248 extending a distance 246 on each side of the cut plane 242 defining the outboard connecting seam 244 is removed from the side sill reinforcing structure 234, and a portion 250 extending to a transverse line 252 as shown in FIG. 25 is removed from the transition plate 224 on each side of the car body 206. The diagonal beams 222 and their attaching plates fastening them to the transition plates 224 adjacent the floor assembly 218 and to a transverse beam 254 extending across the bottom of the container well 210 adjacent the container well end plate 216 are removed. The end portion of the car body, including the body bolster 214 and the attached transitional portions 256 of the side sills 212, may be supported movably and separated from the longitudinally central portions of the side sills 212 defined by the cut plane 242, shown in FIGS. 24 and 25, by a distance of somewhat more than 30 inches to allow the extension portions 232 to be inserted into each of the side sills 212.

The process of installing the extension portions 232 is similar to the process of installation of side sill extension portions 88 and 154 and revisions of container well bottom truss assemblies in the previously described container-well car units. The side sill extension portions 232 include web plate extension portions 262, top chord channel extension portions 274, and transition plate extension portions 270, all welded together. Backup bars may be welded in place at the opposite ends of the top chord as in the previously described side sill extension portions 88,154, and 200. The side sill extensions 232 for the car body 206 are aligned with the end portions of the side sills 212, extending from the body bolster 214, and are tack welded into place on the end portions of the side sills 212. Backing bars (not shown) may also be installed along the margins of the side sill web plate 228 aligned with the top chord channel 226. The side sill web plate extension 262 may be tack welded into position along the outboard connecting seam 244 as shown in FIGS. 26 and 27 with a backing bar 260. The end portion of the car body 206, with the side sill extension portions 232 tack welded in place along the connecting seam 244, may then be moved into alignment with the longitudinally central portion of the car body 206. The side sill extension portions 232 may be attached to the longitudinally central position along the inboard connecting seam 245, with a backing bar 260 along the laterally inward side of the web plate extension portion 262. Backing bars 268 are installed on the exterior and bottom margins of the remaining portions of the transition plates 224 at the bottom of the container well, along the cut plane 242 and the cut line 252 shown in FIGS. 24 and 25, and a transition plate extension portion 270 may be welded into place along the laterally inner side of the side sill 212 as shown in detail in FIG. 31. When the side sill extension portions 232 are all tack welded into position the weld joints may be completed along the connecting seams 244 and 245.

An exterior doubler plate extension 264 may then be welded into place in the doubler plate 266 along the longitudinally outboard connecting seams 244 and 245, as shown in FIGS. 28 and 29.

Thereafter, a side sill reinforcing structure extension 278 may be installed atop the lengthened side sills 212 at each end of the car body 206, using backing plates 280 to form appropriately strong weld joints.

Diagonal beams 272, longer than the removed beams 222, are installed, with attachments at the appropriate angles, to extend between the transverse beam 254 and the transitional portion at the end of the floor assembly 218 as may be seen in FIG. 30.

Once extension portions 232 and side sill reinforcing structure extensions 278 have been installed at both ends of the car body 208, the extended car body may be checked as to sufficient mid-length rail clearance height. A doubler plate 282 may be added on either the exterior side of the side sill web plate 228, as shown in FIG. 32, or on the interior side of the web plate 228, or on both sides, in order to ensure sufficient camber in the side sill 212, so as to provide ample clearance beneath the car body 208 at the middle of its length. As mentioned previously the process of welding such a reinforcement plate 282 to the side sills can be utilized to shrink the side sill a small amount, in order to provide additional camber and prevent sagging in the middle of the length of the car body 206.

An additional strengthening doubler plate 284 may also be attached to the top of the top chord channel member 226 at the mid-length position along the side sill 212 on each side, to provide additional material to enhance the camber and the side sill load capacity of the car body 206 as required.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of lengthening a container well for intermodal cargo containers in a car body of a railroad freight car, comprising:

(a) while supporting a center portion of a car body, separating each one of a pair of opposite end portions of the car body from the center portion by:

(i) cutting each of a pair of opposite side sills, in each of said opposite end portions of the container well, at a respective location between a body bolster of the respective one of the end portions of the car body and a respective container support assembly that is a nearest one of a plurality of container support assemblies located in the container wells; and (ii) removing a respective member of a container well bottom structure extending generally horizontally through each of said opposite end portions of the container well between the respective nearest one of said plurality of container support assemblies and the body bolster of the respective one of the pair of opposite end portions;

(b) moving each of said pair of opposite end portions of the car body away from the center portion;

(c) fastening a respective side sill extension structure into each of the pair of side sills, between the central portion of the car body and each of said pair of opposite end portions, thereby forming a pair of extended opposite side sills each including an extension at each of said pair of opposite ends of said center portion; and (d) installing a respective replacement member in the container well bottom, extending the container well bottom structure to compensate for the side sill extension structure at each one of said pair of opposite end portions of the car body.

2. The method of claim 1 including the further step of reinforcing each side sill in a longitudinally central area of said center portion.

3. The method of claim 1 wherein each said respective side sill extension structure has a predetermined length.

4. The method of claim 1 including performing said step of cutting said side sills in respective locations spaced apart from each said respective nearest one of said plurality of container support assemblies.

5. The method of claim 1, wherein said side sill extension structures are equal in length at both of said pair of opposite end portions of the car body.

6. The method of claim 1, including welding a reinforcing plate to each of the side sills near a bottom chord thereof at a mid-length location along said container well.

7. The method of claim 1 wherein each of said respective locations is within 4 feet from a respective one of said opposite ends of the container well.

8. The method of claim 3 wherein said length of each of said respective side sill extension structure is 30 inches.

* * * * *